US012571268B2

(12) United States Patent
Livescu et al.

(10) Patent No.: US 12,571,268 B2
(45) Date of Patent: Mar. 10, 2026

(54) COILED TUBING DRILLING FOR GEOTHERMAL HEATING AND COOLING APPLICATIONS

(71) Applicant: Bedrock Energy, Inc., Los Angeles, CA (US)

(72) Inventors: Silviu Livescu, Austin, TX (US); Joselyn Anly Lai, Los Angeles, CA (US); Joel Aaron Wishkovsky, Austin, TX (US)

(73) Assignee: Bedrock Energy, Inc., Los Angeles, CA (US)

( * ) Notice: Subject to any disclaimer, the term of this patent is extended or adjusted under 35 U.S.C. 154(b) by 378 days.

(21) Appl. No.: 17/976,445

(22) Filed: Oct. 28, 2022

(65) Prior Publication Data

US 2024/0093560 A1 Mar. 21, 2024

Related U.S. Application Data

(63) Continuation-in-part of application No. 17/835,905, filed on Jun. 8, 2022, now Pat. No. 11,520,313.

(60) Provisional application No. 63/398,505, filed on Aug. 16, 2022.

(51) Int. Cl.

| | |
|---|---|
| ***E21B 19/22*** | (2006.01) |
| ***E21B 44/04*** | (2006.01) |
| ***E21B 47/00*** | (2012.01) |
| *E21B 47/12* | (2012.01) |

(52) U.S. Cl.

CPC ..... *E21B 19/22* (2013.01); *E21B 44/04* (2013.01); *E21B 47/00* (2013.01); *E21B 47/12* (2013.01)

(58) Field of Classification Search

CPC ..... E21B 19/22; E21B 44/04; E21B 47/00; E21B 47/12; F24T 10/13

See application file for complete search history.

(56) References Cited

U.S. PATENT DOCUMENTS 4,463,814 A 8/1984 Horstmeyer et al.
4,627,496 A 12/1986 Ashford
(Continued)

FOREIGN PATENT DOCUMENTS

CN 104453848 B 6/2019
EP 0864031 B1 * 4/2004 ..... E21B 19/22

OTHER PUBLICATIONS

Bedrock Energy, Inc., Extended European Search Report, EP23177816.8, Oct. 31, 2023, 8 pgs.
(Continued)

*Primary Examiner* — Vincent H Tran
(74) *Attorney, Agent, or Firm* — Morgan, Lewis & Bockius LLP

(57) ABSTRACT

A system includes a power unit, and a coiled tubing (CT) reel for spooling a CT string. The system includes a CT injector for injecting the CT string from a surface into a subsurface to construct a geothermal borehole. The CT injector includes a gooseneck for guiding the CT string into a body of the CT injector. The system includes a first arm for coupling the CT reel and the power unit. The system includes a second arm for coupling the CT injector and the power unit. The system is configured to modify the distance between the CT reel and the gooseneck by adjusting at least one of (i) the length of the first arm or (ii) the length of the second arm.

18 Claims, 24 Drawing Sheets

(56) References Cited

U.S. PATENT DOCUMENTS 5,040,601 A * 8/1991 Karlsson ..... E21B 43/04 166/278
5,839,514 A * 11/1998 Gipson ..... E21B 19/22 166/85.5
6,021,377 A 2/2000 Dubinsky et al.
6,092,756 A * 7/2000 Sola ..... E21B 19/22 166/77.2
6,116,345 A * 9/2000 Fontana ..... E21B 19/084 166/360
6,264,128 B1 * 7/2001 Shampine ..... B65H 75/425 242/157.1
6,454,014 B2 9/2002 Coats
6,629,570 B1 10/2003 Head
6,860,320 B2 3/2005 Johnson, Jr. et al.
7,284,618 B2 * 10/2007 Geddes ..... B65H 75/4413 166/85.5
8,627,896 B2 * 1/2014 Wood ..... E21B 19/22 166/77.2
9,316,067 B1 * 4/2016 Lu ..... E21B 19/22
9,488,388 B1 11/2016 Siegenthaler
9,631,478 B2 4/2017 Livescu et al.
10,233,699 B2 * 3/2019 Backer ..... E04H 12/187
10,280,729 B2 5/2019 Livescu et al.
10,472,944 B2 11/2019 Wassell
10,815,774 B2 10/2020 Livescu et al.
10,822,942 B2 11/2020 Livescu et al.
10,844,707 B2 11/2020 Garner et al.
10,995,563 B2 5/2021 Søe et al.
11,520,313 B1 12/2022 Livescu
2001/0052427 A1 12/2001 Eppink et al.
2006/0086536 A1 * 4/2006 Boyle ..... E21B 47/13 175/107
2007/0107900 A1 * 5/2007 Dreelan ..... E21B 19/09 175/50
2007/0187108 A1 * 8/2007 Zheng ..... E21B 19/09 166/354
2007/0246261 A1 * 10/2007 Lowe ..... E21B 19/22 175/122
2008/0077332 A1 * 3/2008 Newman ..... G01N 3/32 702/33
2008/0093125 A1 4/2008 Potter
2008/0185139 A1 * 8/2008 Ives ..... B65H 75/14 254/323
2009/0114403 A1 * 5/2009 Borst ..... E21B 17/20 166/77.2
2009/0218106 A1 * 9/2009 Stukey ..... E21B 43/128 166/77.2
2012/0201604 A1 * 8/2012 Drieu ..... E21B 43/0122 405/62
2013/0186640 A1 * 7/2013 Webre ..... E21B 19/08 166/85.5
2013/0333900 A1 12/2013 McCulloch
2013/0341001 A1 * 12/2013 Kos ..... E21B 19/22 166/77.2
2014/0196953 A1 7/2014 Chitwood et al.
2015/0083492 A1 3/2015 Wassel
2015/0260015 A1 9/2015 Ludvigsen et al.
2015/0292282 A1 * 10/2015 Dyck ..... B65H 75/425 166/385
2015/0315861 A1 * 11/2015 Zachariasen ..... E21B 15/003 166/77.2
2015/0322766 A1 11/2015 Veltman
2016/0314420 A1 10/2016 Livescu et al.
2016/0333651 A1 * 11/2016 Bjørnenak ..... B66D 3/003
2017/0037685 A1 2/2017 Strachan
2018/0371889 A1 12/2018 Hohl et al.
2019/0137134 A1 5/2019 Koop
2019/0360284 A1 * 11/2019 Søe ..... B65H 75/4405
2020/0355839 A1 11/2020 Jeong et al.
2021/0246742 A1 * 8/2021 Rolovic ..... E21B 17/041
2021/0254412 A1 * 8/2021 Quero ..... E21B 17/20
2021/0332654 A1 * 10/2021 Patterson ..... E21B 19/24
2021/0354951 A1 * 11/2021 Stewart ..... B65H 75/243
2022/0025707 A1 1/2022 Xiao et al.
2022/0188712 A1 6/2022 Mittal et al.
2023/0110623 A1 * 4/2023 Ogundare ..... E21B 44/06 166/381
2025/0101810 A1 3/2025 Rowcliffe et al.

OTHER PUBLICATIONS

Livescu, Notice of Allowance, U.S. Appl. No. 17/835,905, Aug. 1, 2022, 10 pgs.
Livescu, Office Action, U.S. Appl. No. 18/629,546, Jul. 15, 2024, 15 pgs.
Pastorek et al., "Downhole Sensors in Drilling Operations," Proceedings, 44th Workshop on Geothermal Reservoir Engineering, Stanford University, Stanford, California, Feb. 11-13, 2019, 9 pgs.
Livescu, Office Action, U.S. Appl. No. 18/645,113, Jun. 3, 2025, 12 pgs.

* cited by examiner

| | Surface Data | Downhole data |
|---|---|---|
| **Mud Data** | Pit volume<br>Mud temperature<br>Mud pressure<br>Mud weight<br>Pump strokes | N/A |
| **Well Data** | Temperature<br>Pressure<br>Gas measurements | Temperature<br>Pressure |
| **Directional Data** | | Inclination<br>Azimuth |
| **Drilling Mechanics** | RPM<br>Weight on bit<br>Torque<br>Bending moment<br>Rotary torque<br>Hook load<br>Rate of penetration | RPM<br>Weight on bit<br>Torque on bit<br>Bending moment<br>Downhole vibration |
| **Geological data** | Cutting analysis | Density<br>Porosity<br>Resistivity<br>Gamma |

Figure 6

COILED TUBING DRILLING FOR GEOTHERMAL HEATING AND COOLING APPLICATIONS

RELATED APPLICATIONS

This application is a continuation-in-part of U.S. patent application Ser. No. 17/835,905, filed Jun. 8, 2022, entitled "Geothermal Well Construction for Heating and Cooling Operations," which is hereby incorporated by reference herein in its entirety.

This application claims priority to U.S. Provisional Patent Application No. 63/398,505, filed Aug. 16, 2022, entitled "Coiled Tubing Drilling for Geothermal Heating and Cooling Applications," which is hereby incorporated by reference herein in its entirety.

TECHNICAL FIELD

The disclosed implementations relate generally to geothermal heating and cooling systems, and more specifically to systems, methods, and devices for planning, constructing, and optimizing geothermal wells for geothermal heating and cooling system operations.

BACKGROUND

Geothermal energy is a renewable resource that harnesses the Earth's heat. Just a few feet below the surface, the Earth maintains a near-constant temperature, in contrast to the summer and winter extremes of the ambient air above ground.

Installing a geothermal heating and cooling system (GHCS) (also referred herein as a geothermal system) generally involves drilling one or more geothermal wells (e.g., geothermal boreholes) horizontally or vertically, depending on the characteristics of the site. A looped pipe is constructed from the geothermal wells, and heat is transferred between the building (e.g., a residential or commercial building) and the earth using fluid circulated through the looped pipes.

SUMMARY

Current GHCS installations have several drawbacks. First, these installations generally do not take into account surface or subsurface conditions of the site in which the geothermal system would be installed. Instead, standard-sized geothermal wells (e.g., geothermal boreholes) are usually constructed, with depths, lengths, and spacings that are pre-determined based on prior rule-of-thumb experience of the drillers. Second, current residential geothermal systems tend to have fairly shallow well depths (e.g., around 20 feet deep for horizontal geothermal loops) with a large amount of pipes buried horizontally. For example, a typical 2,000-square-foot home uses around 1,500 to 1,800 feet of pipes. Larger buildings, such as industrial, commercial or multi-story residential, would require impractical lengths of horizontal pipes.

Drilling geothermal wells without proper planning and engineering design can lead to non-optimal performance of the geothermal systems, both short-term and in the long run. This directly translates into higher operating costs and unreliable heating and cooling systems for the building owners. Furthermore, the current installation model for residential geothermal systems, which utilizes shallow geothermal wells and large horizontal areas, is not scalable for buildings that are bigger in size (e.g., commercial buildings), have higher energy loads, and/or are located in areas of higher density. For example, a commercial building located in a city may require multiple deep geothermal boreholes, constructed vertically, to be drilled for a geothermal system to properly work.

Moreover, current drilling technologies for geothermal and hydrocarbon well construction are divided between (Category A) small drilling rigs for shallow water or geothermal wells (e.g., 100 to 400 feet long vertical (e.g., deep) wells, and (Category B) large drilling rigs for deep oil & gas and conventional geothermal wells (e.g., 10,000 to 30,000 feet long vertical wells). No off-the-shelf drilling rig exists commercially for mid-range-length wells that are between 500 and 10,000 feet deep. Therefore, no off-the-shelf drilling rig has been developed for this range, leaving a technology gap between Categories A and B. While shallow water well drilling rigs (Category A) are small and portable enough to be transported and operated in high-density urban areas, they do not go very deep and are not very fast. The deep oil and gas rigs (Category B) are fast and powerful, but also large and heavy, and are meant to operate in remote areas far from urban/suburban development. This leaves a gap for fast and strong, yet compact and portable drilling rigs that can operate in urban/suburban/rural areas.

In addition to the technology gap for mid-range length geothermal wells, several constraints exist when it comes to constructing geothermal boreholes in urban (e.g., high-density), suburban, and, or commercial areas. These include space limitations, weight limitations (e.g., the drill rig needs to be transported to and from the construction site via paved concrete roads), and noise generated during well construction.

Accordingly, there is a need for improved systems, methods, and devices that enable design and execution of a GHCS operation. The present disclosure describes an improved system and method for planning and performing a GHCS construction operation, which combines data modeling, hardware components, and an integrated workflow that can be used pre-operation, during the operation, and post-operation. This combination of features differentiates from existing systems for decarbonizing the commercial, industrial, and large residential building sector and for assuring confidence and consistent predictability in the long-term optimum performance of GHCS.

There is also a need for improved systems, methods, and devices for drilling mid-range-length geothermal wells (e.g., 500 and 10,000 feet deep) in urban (e.g., high-density), suburban, and, or commercial areas.

The systems, methods, and devices of this disclosure each have several innovative aspects, no single one of which is solely responsible for the desirable attributes disclosed herein.

In accordance with some implementations of the present disclosure, a system for constructing geothermal boreholes comprises a power unit. The system comprises a coiled tubing (CT) reel for spooling a CT string. The system comprises a CT injector for injecting the CT string from a surface into a subsurface to construct a geothermal borehole. The CT injector includes a gooseneck for guiding the CT string into a body of the CT injector. The system includes a first arm for coupling the CT reel and the power unit. The system also includes a second arm for coupling the CT injector and the power unit. The system is configured to modify a distance between the CT reel and the gooseneck by adjusting at least one of (i) a length of the first arm or (ii) a length of the second arm.

In some implementations, the first arm comprises a telescopic arm.

In some implementations, the second arm comprises a telescopic arm.

In some implementations, the CT injector and the gooseneck are supported by a mast, or another type of crane.

In some implementations, the mast comprises a telescopic mast.

In some implementations, the system is configured to modify the distance between the CT reel and the gooseneck according to a diameter and/or a wall thickness of the CT string.

In some implementations, the system is configured to modify the distance between the CT reel and the gooseneck according to a length of the CT string and/or a planned depth of the geothermal borehole.

In some implementations, the system is configured to modify the distance between the CT reel and the gooseneck for transporting the system.

In some implementations, the system is configured to adjust the distance between the CT reel and the gooseneck according to a depth of the geothermal borehole to be constructed.

In some implementations, the power unit is mounted on a chassis of the system. The system further includes a third arm for coupling the CT reel and the chassis and a fourth arm for coupling the injector and the chassis.

In some implementations, the system is configured to modify the distance between the CT reel and the gooseneck by adjusting at least one of (i) a length of the third arm or (ii) a length of the fourth arm.

In some implementations, the third arm and the fourth arm are telescopic arms.

In some implementations, the CT string is injected into the subsurface via a first end of the CT string. The system further includes a drill bit mounted on the first end.

In some implementations, a plurality of sensors mounted (i) on and/or in the drill bit or (ii) on a telemetry subassembly between the drill bit and a CT connector.

In some implementations, the plurality of sensors includes a force sensor and/or a torque sensor and/or an azimuth sensor and/or a gamma ray sensor and/or an inclinometer sensor and/or an accelerometer sensor.

In some implementations, the system is configured to modify a drilling direction according to sensor data from the force sensor and/or the torque sensor and/or the azimuth sensor and/or the inclination sensor.

In some implementations, the system is configured to modify a drilling speed according to sensor data from the force sensor and/or the torque sensor and/or the accelerometer sensor.

In some implementations, the system is configured to modify an injection speed of the CT injector according to sensor data from the force sensor and/or the torque sensor and/or the accelerometer sensor.

In accordance with some implementations of the present disclosure, a method for optimizing a GHCS operation comprises receiving user specification of (i) one or more input parameters, and/or (ii) a first coefficient of performance (COP) of a heat pump, and/or (iii) one or more temperatures of a geothermal fluid, such as an inlet and/or an outlet temperature and/or (iv) a heat transfer coefficient of the heat between the subsurface and a geothermal borehole (e.g., a first geothermal borehole), for constructing a first geothermal borehole. The method comprises, based on at least a subset of the input parameters and the first COP, applying a model to determine a set of operational parameters for constructing the first geothermal borehole. The method comprises constructing the first geothermal borehole according to the set of operational parameters, including: deploying a coiled tubing (CT) or joint drill pipe enabled drill bit; collecting, in real time during the constructing, sensor data from a plurality of sensors positioned on the drill bit; updating the model according to the sensor data; updating the operational parameters according to the updated model; and controlling the construction of the first geothermal borehole according to the updated operational parameters.

In some implementations, updating the model according to the sensor data includes computing a second COP of the heat pump based on the sensor data; and updating the model according to the second COP.

In some implementations, updating the operational parameters includes updating one or more of: a drilling depth, a drilling diameter; and/or a drilling direction.

In some implementations, the plurality of sensors are positioned on both an interior surface and an exterior surface of the drill bit.

In some implementations, the plurality of sensors include two sensors having a same type, wherein one of the two sensors is positioned on the interior surface of the drill bit and the other of the two sensors is positioned on the exterior surface of the drill bit.

In some implementations, the plurality of sensors measures a plurality of: pressure, temperature, fluid flow, and/or directional data.

In some implementations, applying the model to determine the set of operational parameters includes: generating a range of borehole temperatures and/or borehole sizes based on the at least a subset of the plurality of input parameters and the first COP; and determining the set of operational parameters based on the range of borehole temperatures and/or borehole sizes.

In some implementations, the range of borehole temperatures and/or borehole sizes are generated according to a range of COP values based on the first COP.

In some implementations, the one or more input parameters include a first input parameter specifying a span of time for calculating a long-term COP. Applying the model to determine the set of operational parameters includes computing an aggregated COP of the heat pump over the span of time; and generating a range of borehole temperatures and/or borehole sizes according to the aggregated COP.

In some implementations, the method further comprises repeating the steps of collecting sensor data, updating the model, and updating the operational parameters during the construction of the first geothermal borehole.

In some implementations, the model is stored locally on a computing device that is co-located with the construction of the first geothermal borehole.

In some implementations, the model is stored on a remote server. Updating the model according to the sensor data includes transmitting the sensor data from a computing device, co-located with the construction of the first geothermal borehole, to the remote server, wherein the server is configured to update the model according to the sensor data.

In some implementations, the method further comprises, after constructing the first geothermal borehole, computing a second COP of the heat pump according to at least one of: (i) an inlet temperature and an outlet temperature or (ii) a measured bottom hole temperature of a geothermal loop constructed based on the first geothermal borehole. The method comprises comparing the second COP with a predicted COP. The method comprises, in accordance with a determination that the second COP does not match the predicted COP, adjusting a flow rate of a working fluid of the geothermal loop. The method comprises, in accordance with a determination that the second COP matches the predicted COP, maintaining the flow rate of the working fluid of the geothermal loop.

In some implementations, the method further comprises continuously adjusting the flow rate of the working fluid based on daily temperature fluctuations.

In some implementations, the method further comprises periodically adjusting the flow rate of the working fluid based on seasonal temperature fluctuations.

In some implementations, the method further comprises adjusting the flow rate of the working fluid based on an energy load of the geothermal loop.

In some implementations, the method further comprises repeating the steps of computing and comparing at a predefined time interval.

In some implementations, the geothermal loop is a geothermal loop is used for heating and cooling a building. The method further comprises reversing a heat transfer direction in the building according to a predefined time interval. In some implementations, the method also comprises repeating the steps of computing and comparing in accordance with the reversed heat transfer direction.

In accordance with some implementations of the present disclosure, a system for optimizing a GHCS operation comprises a drilling rig and a processor. The drilling rig is configured to construct a first geothermal borehole according to a set of operational parameters and deploy a CT or joint drill pipes enabled drill bit. The drill bit includes downhole telemetry and is configured to measure downhole conditions in real time. The processor is configured to receive user specification of (i) one or more input parameters and (ii) a first coefficient of performance (COP) of a heat pump for constructing the first geothermal borehole. The processor is configured to, based on at least a subset of the input parameters and the first COP, apply a model to determine the set of operational parameters for constructing the first geothermal borehole. The processor is configured to collect, in real time during the construction, sensor data from a plurality of sensors positioned on the drill bit. The processor is configured to update the model according to the sensor data. The processor is configured to update the operational parameters according to the updated model. The processor is configured to control the construction of the first geothermal borehole according to the updated operational parameters.

In accordance with some implementations, a computing device includes one or more processors, memory, and one or more programs stored in the memory. The programs are configured for execution by the one or more processors. The one or more programs include instructions for performing any of the methods described herein.

In accordance with some implementations, a non-transitory computer-readable storage medium stores one or more programs configured for execution by a computing device having one or more processors and memory. The one or more programs include instructions for performing any of the methods described herein.

Thus methods, systems, and devices are disclosed that enable optimal design, execution, and performance of GHCS operations.

Note that the various implementations described above can be combined with any other implementations described herein. The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes and may not have been selected to delineate or circumscribe the inventive subject matter.

BRIEF DESCRIPTION OF THE DRAWINGS

FIG. 6 illustrates exemplary types of surface data and downhole data that are collected by sensors in accordance with some implementations.

Reference will now be made to implementations, examples of which are illustrated in the accompanying drawings. In the following description, numerous specific details are set forth in order to provide a thorough understanding of the present invention. However, it will be apparent to one of ordinary skill in the art that the present invention may be practiced without requiring these specific details.

DESCRIPTION OF IMPLEMENTATIONS

Some methods, devices, and systems disclosed in the present specification improve upon geothermal heating and cooling system (GHCS) operations by providing an integrated workflow that combines data modeling, hardware components, and a workflow for planning, executing, and/or optimizing a GHCS installation operation.

In accordance with some aspects of the present disclosure, the GHCS operation includes drilling one or more geothermal wells (e.g., boreholes). GHCS drilling employ various technologies and methods to drill and construct geothermal boreholes in urban, suburban, and rural areas. Methods of drilling geothermal boreholes include joint pipe drilling and CT drilling. Performing an optimal geothermal drilling operation involves modeling design before the operation, using downhole parameters such as a borehole size and length, mechanical friction forces, tensile forces, pumping rates, soil and rock properties, pressure and/or temperature. Some aspects of the present disclosure describe using surface and subsurface (e.g., underground) sensors for acquiring data such as pressure, temperature, depth correlation and azimuth, rock hardness, pumping rates, etc., for adjusting the pre-operation design in real time while drilling. Some aspects of the present disclosure describe using the same model after the GHCS drilling and construction operation is finished, to monitor the geothermal loop inlet and outlet temperature and enthalpy, the indoor temperature, and/or the coefficient of performance of the heat pump in real time, and to adjust the pump rate to maintain an optimal heating and cooling performance.

Figure 1:
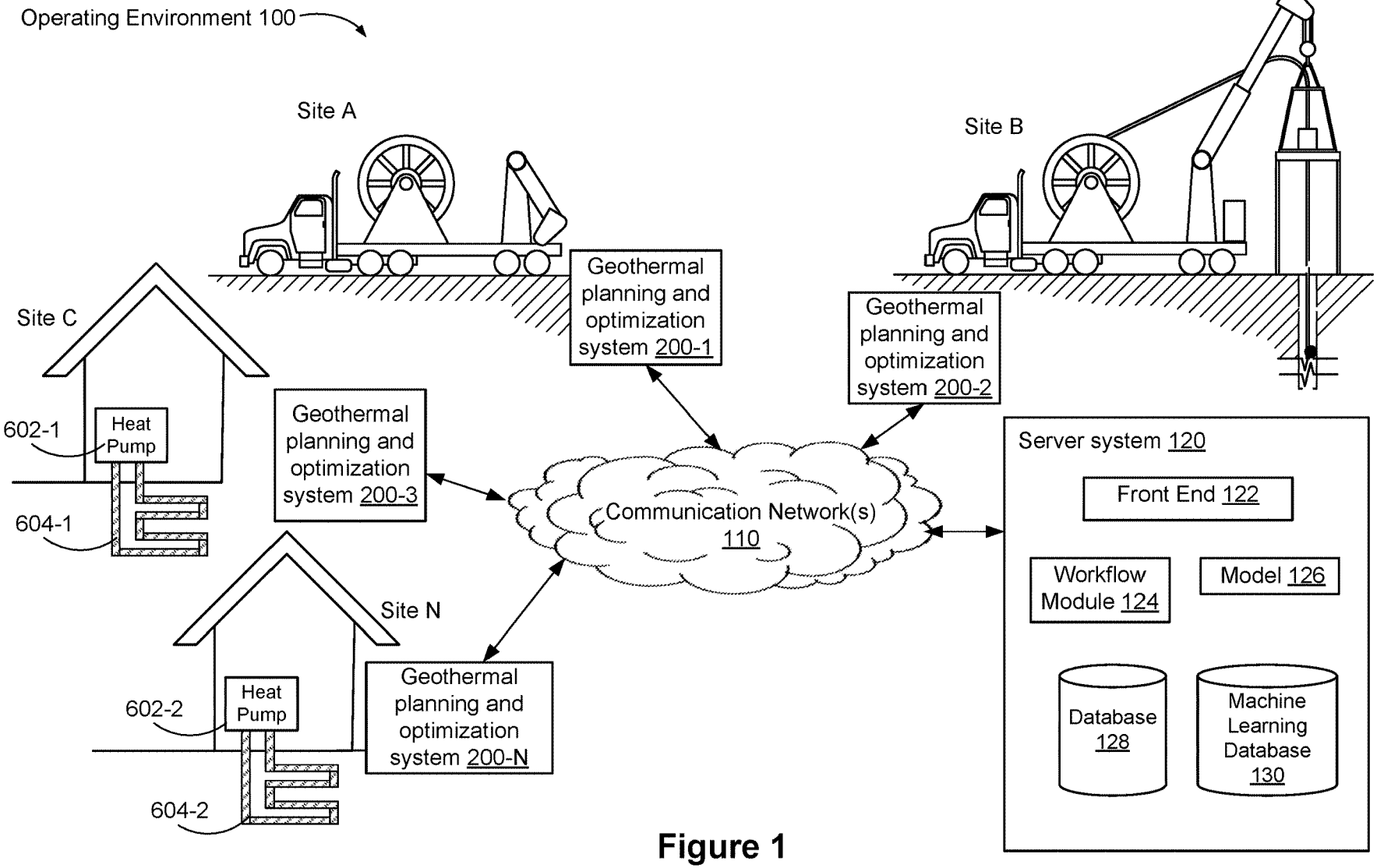
FIG. 1 illustrates an operating environment in accordance with some implementations.

FIG. 1 illustrates an operating environment 100 in accordance with some implementations. In some implementations, the operating environment 100 includes one or more geothermal planning and optimization systems 200 (e.g., a computer system a computing device, or an electronic device). In the example of FIG. 1, each of the systems 200-1, 200-2, 200-3, and 200-N is located at a respective (e.g., distinct) site (e.g., Site A, Site B, Site C, Site N), corresponding to a respective (e.g., distinct) city, state, or country.

In some implementations, each of the geothermal planning and optimization systems 200 is configured to be operable at various phases (e.g., all phases, all stages, or a subset thereof) of a GHCS operation. The phases can include a pre-construction phase, a construction phase, and a post-construction phase. For example, in FIG. 1, the geothermal planning and optimization system 200-1 located in Site A corresponds to the pre-construction phase. The system 200-2 located in Site B corresponds to the construction phase. The systems 200-3 and 200-N, in Site C and Site N respectively, correspond to the post-construction phase.

In some implementations, the geothermal planning and optimization system 200 is communicatively coupled through communication network(s) 110 to a server system 120.

In some implementations, the server system 120 includes a front end server 122 that facilitates communication between the server system 120 and the geothermal planning and optimization system 200. The front end server 122 is configured to receive information from the geothermal planning and optimization system 200. For example, during the planning (e.g., pre-construction) phase for a geothermal borehole construction project at Site A, the front end server 122 can receive (e.g., in real-time), from the geothermal planning and optimization system 200-1, information such as building size, site information, and/or data regarding rock type found at Site A. As another example, during the construction of a geothermal borehole at Site B, the front end server 122 can receive (e.g., in real-time) from the geothermal planning and optimization system 200-2 information such as sensor data collected by one or more sensors of a drilling rig that is performing the borehole construction at Site B. As another example, the front end server 122 can receive (e.g., in real-time) from the geothermal planning and optimization system 200-3 information such as a fluid flow rate and/or a heat pump coefficient of performance (COP) or energy efficiency ratio (EER), corresponding to a geothermal loop 604-1 at Site C.

In some implementations, the front end server 122 is configured to send information to the one or more geothermal planning and optimization systems 200. For example, the front end server 122 can send operational parameters (e.g., drilling depth, diameter, and/or direction) to the geothermal planning and optimization system 200-1, to facilitate drilling of the geothermal borehole at Site A. As another example, in response to receiving the sensor data from the geothermal planning and optimization system 200-2, the front end server 122 can send updated operational parameters to the geothermal planning and optimization system 200-2, to control (e.g., optimize) the dimensions of the geothermal borehole that is being constructed art Site B. As another example, in response to receiving data associated with the geothermal loop 604-1, the front end server 122 can send to the geothermal planning and optimization system 200-3 information such as a desired flow rate for the working fluid, so as to optimize the operation of the geothermal loop 604-1.

In some implementations, the server system 120 includes a workflow module 124 for providing an integrated workflow 628 corresponding a geothermal heating and cooling system operation. Details of the workflow module 124 are discussed in FIGS. 2, 3, and 8.

In some implementations, the server system 120 includes a model 126 (e.g., a physics-based model, a mathematical-based model, a data-driven model, a machine learning algorithm) for modeling the heating and cooling loads of the building, the heat pump, and the GHCS well (e.g., geothermal borehole(s)) sizes and lengths. Details of the model 126 are discussed in FIGS. 2 and 3.

In some implementations, the server system 120 includes a database 128. Details of the database 128 are further described in FIG. 3.

In some implementations, the server system 120 includes a machine learning database 130 that stores machine learning information. In some implementations, the machine learning database 130 is a distributed database. In some implementations, the machine learning database 130 includes a deep neural network database. In some implementations, the machine learning database 130 includes supervised training and/or reinforcement training databases.

Figure 2:
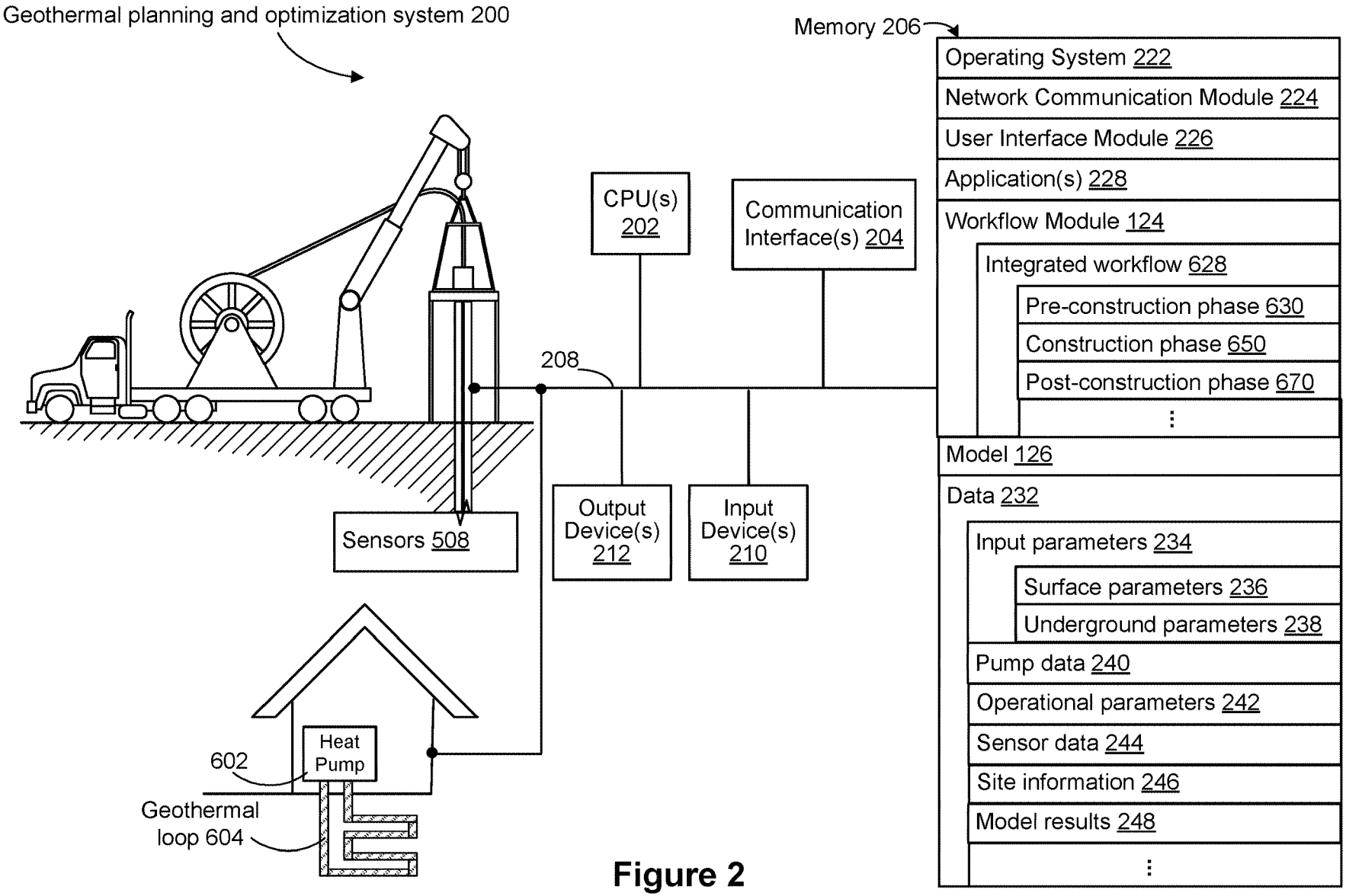
FIG. 2 illustrates a block diagram of a geothermal planning and optimization system according to some implementations.

FIG. 2 illustrates a block diagram of a geothermal planning and optimization system 200 according to some implementations.

The system 200 typically includes one or more processors (e.g., processing units, or CPUs) 202, one or more network or other communication interfaces 204, memory 206, and one or more communication buses 208 for interconnecting these components. In some implementations, the communication buses 208 include circuitry (sometimes called a chipset) that interconnects and controls communications between system components.

In some implementations, the system 200 is communicatively connected to one or more sensors 508 that are positioned on a drill bit 502 of a CT 408 and/or a joint pipe 422, the details of which are described in FIGS. 4, 5, and 6.

In some implementations, the system 200 is communicatively connected to one or more heat pumps 602 that are operably coupled to one or more respective geothermal loops 604. Details of the heat pump 602 and the geothermal loop are described in FIG. 7.

The system 200 includes one or more input devices 210 that facilitate user input, such as a keyboard, a mouse, a voice-command input unit or microphone, a touch screen display, a touch-sensitive input pad, a gesture capturing camera, or other input buttons or controls. In some implementations, the system 200 includes one or more cameras or scanners for capturing data. The system 200 also includes one or more output devices 212 that enable presentation of user interfaces and display content, including one or more speakers and/or one or more visual displays.

In some implementations, the memory 206 includes high-speed random access memory, such as DRAM, SRAM, DDR RAM, or other random access solid state memory devices; and, optionally, includes non-volatile memory, such as one or more magnetic disk storage devices, one or more optical disk storage devices, one or more flash memory devices, or one or more other non-volatile solid state storage devices. In some implementations, the memory 206 includes one or more storage devices remotely located from one or more processing units 202. The memory 206, or alternatively the non-volatile memory device(s) within the memory 206, includes a non-transitory computer-readable storage medium. In some implementations, the memory 206 or the computer-readable storage medium of the memory 206 stores the following programs, modules, and data structures, or a subset or superset thereof:

- an operating system 222, including procedures for handling various basic system services and for performing hardware dependent tasks;
- a communications module 224, which is used for connecting the system 200 to other systems, computers and devices via the one or more communication interfaces 204 (wired or wireless), such as the communication network(s) 100, Internet, other wide area networks, local area networks, metropolitan area networks, and so on;
- a user interface module 226, which enables presentation of information (e.g., a graphical user interface for application(s) 228, widgets, websites and web pages thereof, and/or audio and/or video content, text, etc.) at the system 200 via one or more output devices 212 (e.g., displays, speakers, etc.);
- one or more user applications 228, which are executed by the system 200 (e.g., web or non-web based applications for controlling another system, electronic device, or sensors, or for reviewing data captured by such devices);
- a workflow module 124, which provides an integrated workflow 628 corresponding a GHCS operation;
- a model 126, which models the heating and cooling loads of the building, the heat pump, and the GHCS well (e.g., geothermal borehole(s)) sizes and lengths); and
- data 232, including:
  - input parameters 234. In some implementations, the input parameters 234 include surface parameters 236. The surface parameters 326 include: building size, building type (e.g., wall material and insulation; roof type; number, size, and orientation of windows; ventilation system; etc.), location, outdoor temperature, heat pump size, heat pump type, and/or inlet/outlet temperatures of the geothermal loop. In some implementations, the input parameters 234 include underground parameters 238. The underground parameters 238 include: fluid type (e.g., density and/or viscosity, and thermal conductivity), geothermal loop roughness, inlet temperatures of the geothermal loop(s), geothermal loop length and/or depth, size (e.g., diameter), and trajectory (e.g., vertical, horizontal, inclined, and/or deviated), geothermal loop material/heat transfer coefficient, soil and/or rock type and properties, aquifer depth and height, grout/cement/casing heat transfer coefficients, and geothermal working fluid flow rate;
  - pump data 240, including manufacturer heat pump COP and/or EER and/or calculated heat pump COP and/or EER (e.g., during borehole construction or during operation of a geothermal loop);
  - operational parameters 242, including drilling depth(s), drilling diameter(s), and/or drilling direction(s);
  - sensor data 244. In some implementations, the sensor data 244 is collected automatically and/or in real time. In some implementations, the sensor data 244 is collected directly (e.g., by sensors 508 or sensors 510) or by indirect measurements. In some implementations, the sensor data 244 includes surface data and/or downhole data, as illustrated in FIG. 6;
  - site information 246, including geographical location(s) of geothermal borehole(s), rock conditions, heat pump(s), geothermal loop(s) and their inlet and outlet temperatures, working fluid type(s), and/or working fluid flow rates; and
  - model results 248 generated by the model 126.

In some implementations, the integrated workflow 628 includes a combination of one or more workflows, each corresponding to a respective phase of a geothermal heating and cooling operation (e.g., a geothermal project). The integrated workflow 628 can include a combination of: a pre-construction phase workflow 630, a construction phase workflow 650, and a post-construction phase workflow 670. In some implementations, each of the workflows 630, 650, and 670 can be executed as a standalone workflow. Details of the workflows 630, 650, and 670 are discussed in FIGS. 8A to 8C;

In some implementations, the model 126 comprises a physics-based model, a mathematical-based model, a data-driven model, and/or a machine learning algorithm. In some implementations during a pre-construction phase, the model 126 uses data 232, such as input parameter(s) 234, and a heat pump COP or EER 242, to predict (e.g., estimate) the length and/or depth of the borehole(s) to be drilled and/or estimate one or more locations for the boreholes. The model 126 generates operational parameters 242 for constructing a geothermal borehole. In some implementations, during a construction phase, the model 126 uses sensor data 244 (e.g., collected in real time using sensors 508 and/or sensors 510) to further refine and/or optimize the operational parameters 242. In some implementations, during a post-construction phase, the model 126 uses inputs such as a surface air temperature, a building size, and/or a heat pump COP to determine heat exchange parameters at a geothermal loop, and determines an optimized flow rate of the fluid in the geothermal loop.

In some implementations, the model 126 comprises a subsurface fluid transport and heat transfer model. The model 126 allows a user to automatedly engineer an entire subsurface system (e.g., engineer the number, size(s), length(s) of geothermal wells (e.g., boreholes), and the distance between wells) specifically designed for each building In some implementations, the model 126 includes a surface sub-model and an underground sub-model. The surface sub-model solves energy balance equations for the building and heat pump(s). For example, the surface sub-model uses a subset of the surface parameters 236 and generates, as outputs, the heat pump efficiency and the geothermal working fluid flow rate. The underground sub-model solves mass, momentum, and energy conservation equations in the geothermal loop(s) and radial diffusivity equation(s) in the underground rocks around the geothermal borehole(s). The underground sub-model uses a subset of the underground parameters 238 and generates (e.g., outputs) an outlet temperature of the geothermal loop. In some implementations, the model 126 couples the surface sub-model and the underground sub-model and solves them together. In this instance, the model 126 uses a subset of the surface parameters 236 and the underground parameters 238 as inputs, and calculates an optimum heat pump efficiency by adjusting the geothermal working fluid flow rate. The unknowns in the model 126 include: underground heat transfer coefficients in the rocks, aquifer, and grout/cement (e.g., the grout/cement thickness may vary along the borehole length). Thus, inlet/outlet temperatures of the geothermal loops and geothermal working fluid flow rates (e.g., site information 246) are measured over time and data sets (e.g., training data training data 326) are built to predict the underground heat transfer coefficients using non-linear least square solvers such as the gradient-based Levenberg-Marquardt algorithm. This, in turn, allows for adjusting the geothermal working fluid flow rates for continuously optimal heat pump efficiencies (e.g., during the day, at night or every day of the year).

Although FIG. 2 shows a system 200, FIG. 2 is intended more as a functional description of the various features that may be present rather than as a structural schematic of the implementations described herein. In practice, and as recognized by those of ordinary skill in the art, items shown separately could be combined and some items could be separated.

Each of the above identified executable modules, applications, or sets of procedures may be stored in one or more of the memory devices, and corresponds to a set of instructions for performing a function described above. The above identified modules or programs (i.e., sets of instructions) need not be implemented as separate software programs, procedures, or modules, and thus various subsets of these modules may be combined or otherwise re-arranged in various implementations. In some implementations, the memory 206 stores a subset of the modules and data structures identified above. Furthermore, the memory 206 may store additional modules or data structures not described above (e.g., module(s) for machine learning and/or training models). In some implementations, a subset of the programs, modules, and/or data stored in the memory 206 are stored on and/or executed by the server system 120.

Figure 3:
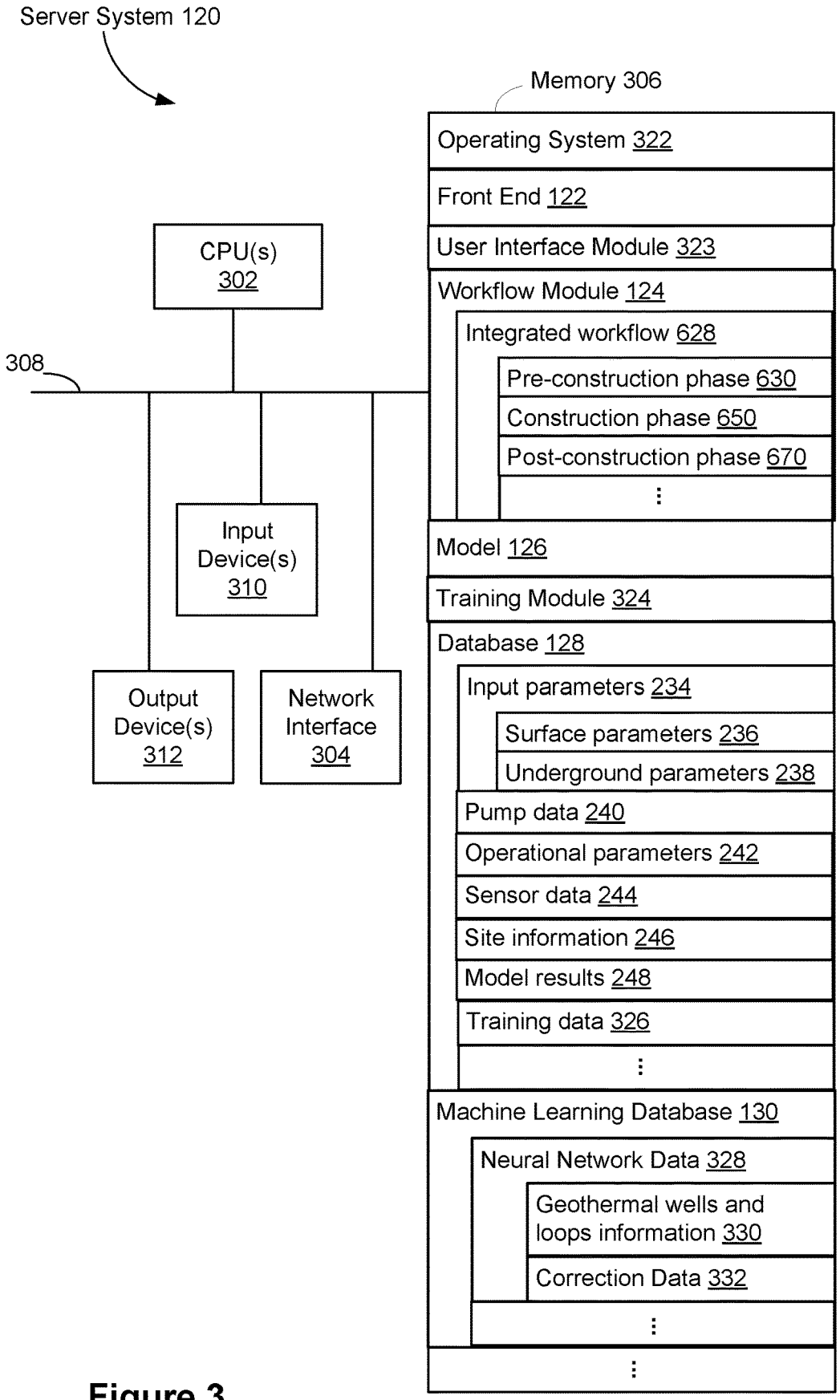
FIG. 3 is a block diagram illustrating a server system, in accordance with some implementations.

FIG. 3 is a block diagram illustrating a server system 120, in accordance with some implementations.

The server system 120 includes one or more processors 302 (e.g., processing units of CPU(s)), one or more network interfaces 304, memory 306, and one or more communication buses 308 for interconnecting these components (sometimes called a chipset), in accordance with some implementations.

In some implementations, the server system 120 includes one or more input devices 310 that facilitate user input, such as a keyboard, a mouse, a voice-command input unit or microphone, a touch screen display, a touch-sensitive input pad, a gesture capturing camera, or other input buttons or controls. In some implementations, the server system 120 uses a microphone and voice recognition or a camera and gesture recognition to supplement or replace the keyboard. In some implementations, the server system 120 includes one or more output devices 312 that enable presentation of user interfaces and display content, such as one or more speakers and/or one or more visual displays.

The memory 306 includes high-speed random access memory, such as DRAM, SRAM, DDR RAM, or other random access solid state memory devices; and, in some implementations, includes non-volatile memory, such as one or more magnetic disk storage devices, one or more optical disk storage devices, one or more flash memory devices, or one or more other non-volatile solid state storage devices. In some implementations, the memory 306 includes one or more storage devices remotely located from the one or more processors 302. The memory 306, or alternatively the non-volatile memory within the memory 306, includes a non-transitory computer-readable storage medium. In some implementations, the memory 306, or the non-transitory computer-readable storage medium of the memory 306, stores the following programs, modules, and data structures, or a subset or superset thereof:

- an operating system 322, including procedures for handling various basic system services and for performing hardware dependent tasks;
- a front end 122, which communicatively couples the server system 120 to other devices and/or systems (e.g., the geothermal planning and optimization systems 200-1, 200-2, 200-3, . . . , 200-N) via the network interface(s) 304 (wired or wireless) and one or more networks, such as communication network(s) 110, the Internet, other wide area networks, local area networks, metropolitan area networks, and so on;
- a user interface module 323, which enables presentation of information (e.g., a graphical user interface for presenting application(s), widgets, websites and web pages thereof, games, audio and/or video content, text, etc.) either at the server system or at a geothermal planning and optimization system 200 (e.g., a computing device);
- a workflow module 124, which provides an integrated workflow 628 corresponding a GHCS operation. In some implementations, the integrated workflow 628 includes one or more of: a pre-construction phase workflow 630, a construction phase workflow 650, and a post-construction phase workflow 670;
- a model 126;
- a training module 324, which generates and/or trains geothermal planning and optimization models (e.g., model 126) for predicting underground heat transfer coefficient(s). In some implementations, the training module 324 uses training data 326 to generate and/or train the models. In some implementations, the training data 326 (e.g., training data sets) is generated from geothermal loop inlet/outlet temperature measurements over time (e.g., one month, six months, one year, five years) and/or geothermal working fluid flow rate measurements over time. In some implementations, the training data 326 is generated from nearby buildings or from buildings with similar thermal energy loads. In some implementations, the training module 324 uses non-linear least square solvers such as the gradient-based Levenberg-Marquardt algorithm, for predicting underground heat transfer coefficient(s) for a GHCS site location. This, in turn, allows for adjusting the geothermal working fluid flow rates for continuously optimal heat pump efficiencies (i.e., during the day or at night, every day of the year);
- a database 128, which stores data used, collected, and/or created by the workflow module 124, the model 126, and/or the training module 324. The database 128 may store input parameters 234, including surface parameters 236 and/or underground parameters 238, which provide the data used in the model 126, the integrated workflow 628, and/or the workflows 630, 650, and 670. In some implementations, the database 128 stores pump data 240 of heat pumps that are installed at sites utilizing the system 200. In some implementations, the database 128 stores operational parameters 242 for constructing geothermal borehole(s), including drilling depth(s), drilling diameter(s), and/or drilling direction(s). In some implementations, the database 128 stores sensor data 244 that are collected by surface and/or subsurface sensors (e.g., sensors 508 and/or sensors 510) located at various geothermal sites. In some implementations, the database 128 stores site information 246 of sites equipped with the system 200, including geographical location(s) of geothermal borehole(s), rock conditions, heat pump(s), geothermal loop(s) and their inlet and outlet temperatures, working fluid type(s), and/or working fluid flow rates. In some implementations, the database 128 stores model results 248 generated by the model 126. In some implementations, the database 128 stores training data 326. In some implementations, the database 128 stores the data by site locations. In some implementations, the database 128 stores the data by a respective identifier of the system(s) 200;

In some implementations, the memory 306 includes a machine learning database 130 for storing machine learning information. In some implementations, the machine learning database 130 includes the following datasets or a subset or superset thereof:

- neural network data 328, including information corresponding to the operation of one or more neural network(s), including, and not limited to:
  - geothermal wells and loops information 330, including information (e.g., feature vectors) corresponding to different locations and/or configurations of geothermal wells (e.g., geothermal boreholes) and geothermal loops; and
  - correction data 332 corresponding to the geothermal wells and loops information 330.

In some implementations, the server system 120 includes a device registration module for registering devices (e.g., the computer device and system) for use with the server system 120.

In some implementations, the server system 120 includes a notification module (not shown) for generating alerts and/or notifications for users of the geothermal planning and optimization system(s) 200. For example, in some implementations the model 126 (or the workflow module 124) is stored locally on the system 200 of the user, the server system 120 may generate notifications to alert the user to download the latest version(s) or update(s) to the model.

Each of the above identified elements may be stored in one or more of the memory devices described herein, and corresponds to a set of instructions for performing the functions described above. The above identified modules or programs need not be implemented as separate software programs, procedures, modules or data structures, and thus various subsets of these modules may be combined or otherwise re-arranged in various implementations. In some implementations, the memory 306 stores a subset of the modules and data structures identified above. In some implementations, the memory 306 stores additional modules and data structures not described above. In some implementations, a subset of the programs, modules, and/or data stored in the memory 306 are stored on and/or executed by the geothermal planning and optimization system 200.

Figure 4A:
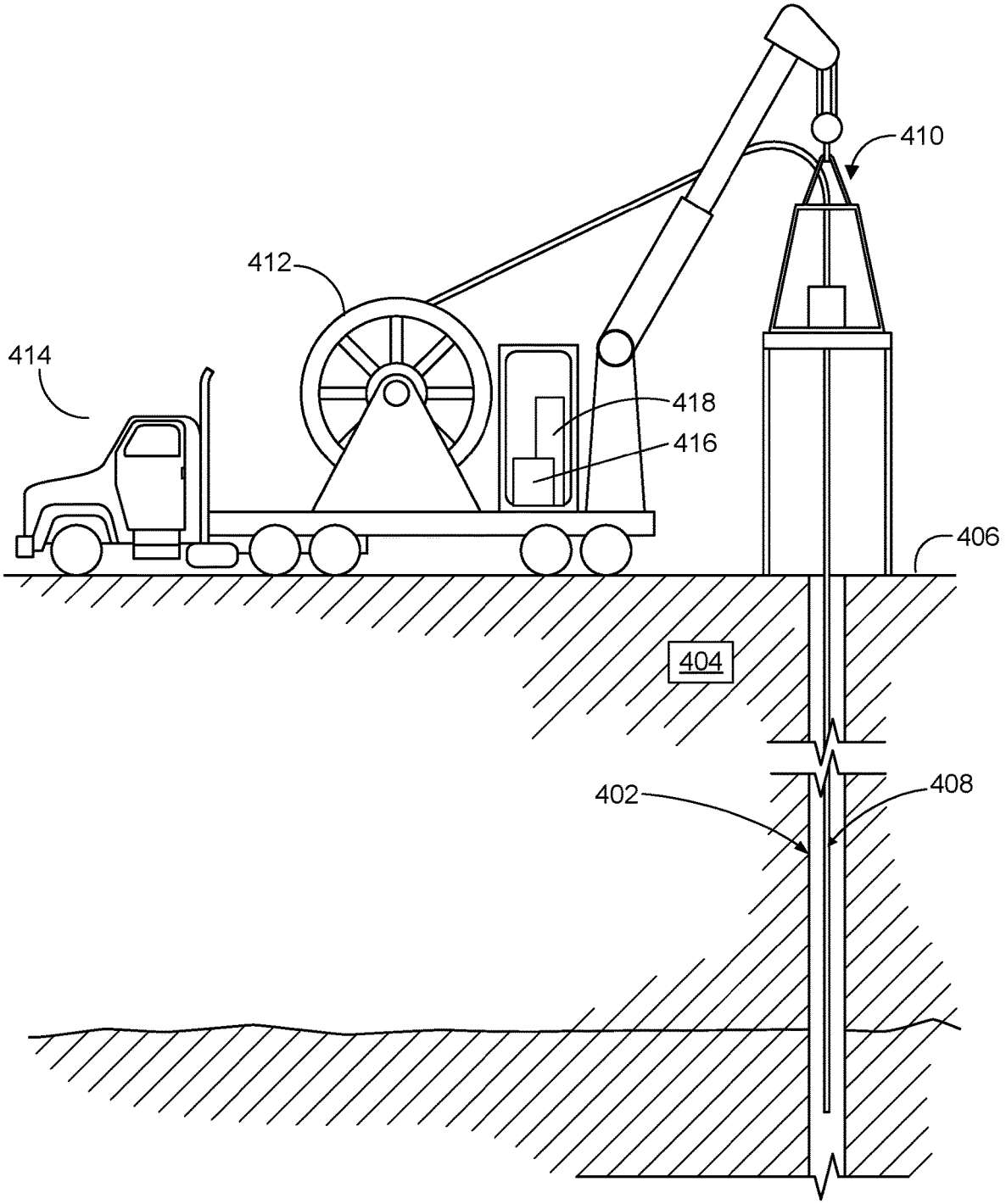
FIGS. 4A and 4B illustrate drilling of a geothermal borehole in accordance with some implementations.
Figure 4B:
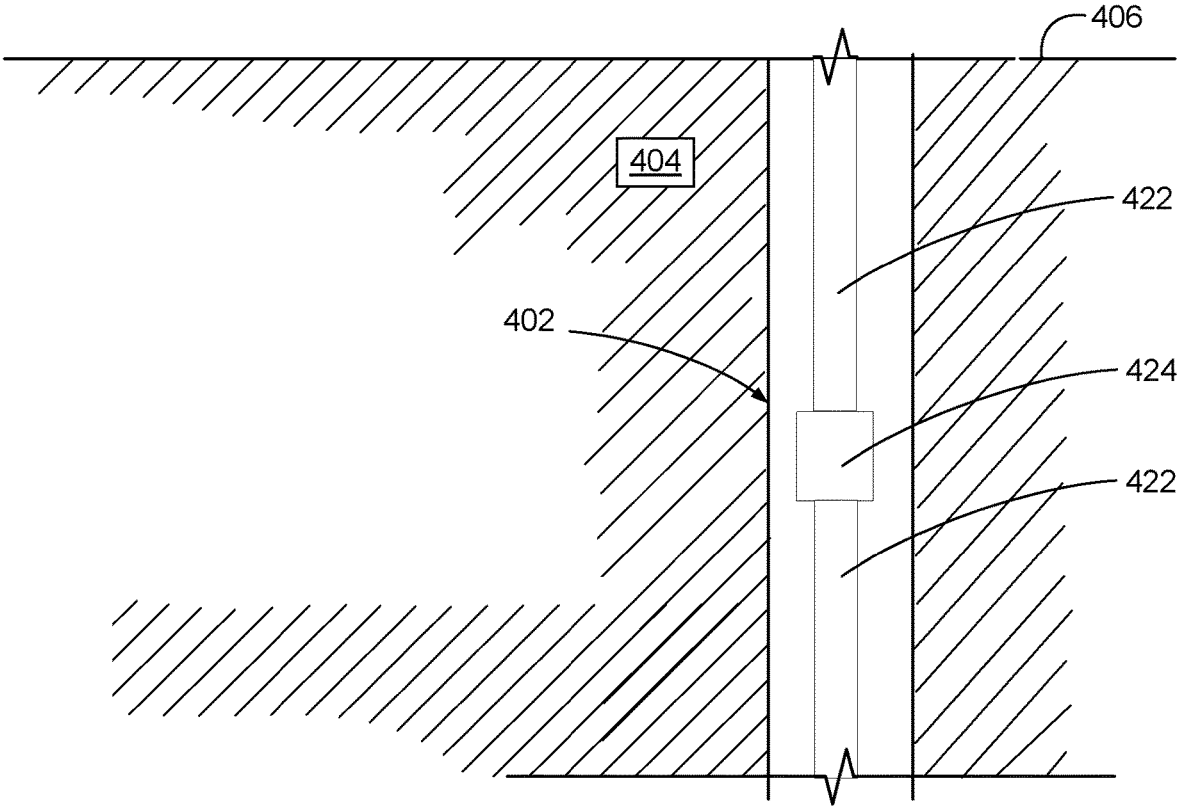

FIGS. 4A and 4B illustrate drilling of a geothermal borehole (e.g., a geothermal well) in accordance with some implementations. In FIG. 4A, an exemplary geothermal borehole 402 has been (e.g., is being) drilled through the earth 404 from the surface 406. While the geothermal borehole 402 in FIG. 4A is illustrated as a substantially vertical borehole, it might, in practice, have portions that are inclined or horizontally-oriented.

In some implementations, as illustrated in FIG. 4A, a drill rig comprising CT 408 is used for constructing the geothermal borehole 402. The CT 408 is tubing that is sufficiently flexible that long lengths can be coiled onto a spool and stored on a CT reel 412 that is mounted on a truck 414, so that it can be injected into a geothermal borehole 402 using a CT injector 410. In some implementations, the truck 414 is provided with a radio frequency (RF) power source or generator 416 and motorized equipment 418 of a type known in the art to rotate the reel 412.

In accordance with some implementations of the present disclosure, the CT reel 412 and/or the CT injector 410 are purposefully re-designed and re-sized for drilling geothermal boreholes with depths of about 1,000 to 2,000 feet. Current drilling technologies for geothermal and hydrocarbon well construction are divided between two categories: (A) small drilling rigs for shallow water or geothermal wells, usually drilling 100 to 400-feet long vertical wells, and (B) large drilling rigs for deep oil & gas and conventional geothermal wells, usually for 10,000 to 30,000 feet long wells. In oil and gas drilling and conventional geothermal drilling, no significant demand has historically existed for mid-range lengths, e.g., between 500 and 10,000 feet. Therefore, no off-the-shelf drilling rig has been developed for this range, leaving a technology gap between (A) and (B). While shallow water well drilling rigs (Category A) are small and portable enough to be transported and operated in high-density urban areas, they do not go very deep and are not very fast. The deep oil and gas rigs (Category B) are fast and powerful, but also large and heavy, and are meant to operate in remote areas far from urban/suburban development. This leaves a gap for fast and strong, yet compact and portable drilling rigs that can operate in urban/suburban/rural areas.

In some implementations, as illustrated in FIG. 4B, a drill rig comprising one or more joint pipes 422 (e.g., joint drill pipes) are used for constructing the geothermal borehole 402. The joint pipes 422 are straight pipes having a fixed length (e.g., 10 feet long) and that are connected together via one or more tool joints 424 while drilling. For example, rigs for drilling geothermal wells for single-family residential applications (Category A) have joint pipes between 10 and 20 feet long.

Current drilling rigs (Categories A and B) use joint pipes. Drilling down, and then exiting the borehole on the way back up, must slow to a standstill when two joint pipes must be connected together. This repetitive process limits the average drilling speed to about 10-100 feet/hour for the entire well drilling operation. In contrast, with continuous CT drilling, the average drilling speeds can reach 150-200 feet/hour. These faster drilling speeds allow a significant reduction in time and operational costs: for instance, a 400-feet long geothermal well can be drilled in only 2 hours, instead of 20+ hours required by the shallow water well drilling rigs (Category A).

FIGS. 5A to 5D illustrate a drill bit 502 for generating geothermal boreholes according to some implementations.

Figure 5A:
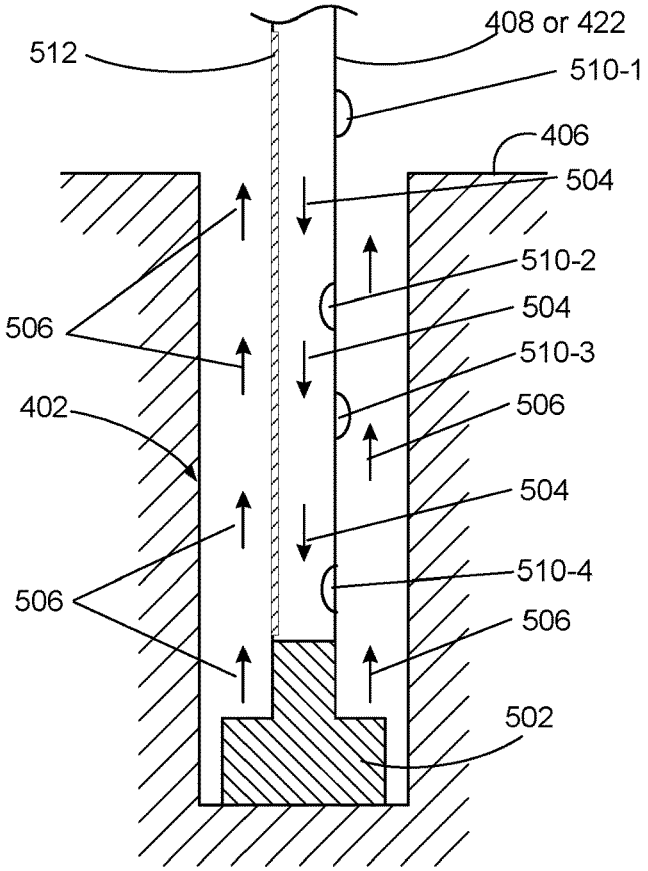
FIGS. 5A to 5D illustrate a drill bit for generating geothermal boreholes according to some implementations.
Figure 5B:
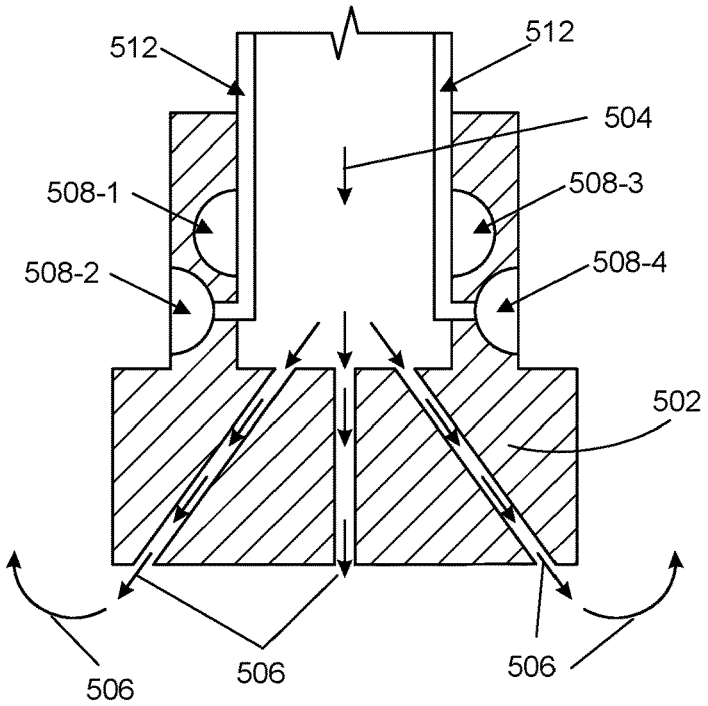

FIG. 5A illustrates a cross-sectional view that shows a drill bit 502 mounted on one end of a CT 408 and/or a joint pipe 422, to facilitate drilling of the geothermal boreholes. FIG. 5B illustrates a cross-sectional view of the drill bit 502 according to some implementations. The drill bit 502 is rotated by a motor (not shown) that is hydraulically activated by pumping drilling fluid (e.g., water and/or bentonite)

through the CT 408 or the joint pipes 422. The arrows 504 in FIGS. 5A and 5B indicate the direction of the drilling fluid as it is pumped through the CT 408 and/or a joint pipe 422. The arrows 506 in FIGS. 5A and 5B indicate the direction of drilling mud (e.g., water and/or bentonite and debris) as it exits the drill bit 502 and motor.

In some implementations, the drill bit 502 includes sensors 508 (e.g., underground or downhole sensors) that are designed to measure underground parameters in-situ, as (e.g., during, while) the geothermal boreholes are being drilled/constructed. The underground parameters include temperature, pressure, humidity, lithology, azimuth, stresses, and/or depth correlation. In some implementations, the sensors 508 collect downhole data having data types that are illustrated in FIG. 6.

In some implementations, the sensors 508 are positioned on both the interior surface and the exterior surface of the drill bit 502. For example, FIG. 5B illustrates four downhole sensors 508-1 to 508-4. The sensors 508-1 and 508-3 are positioned on the interior surface of the drill bit 502. The sensors 508-2 and 508-4 are positioned on the exterior surface of the drill bit 502.

In some implementations, at least two of the sensors 508 have the same sensor type. As an example, the sensor 508-1 and the sensor 508-2 can both be temperature sensors. As another example, the sensor 508-1 and the sensor 508-3 can both be pressure sensors.

In some implementations, the sensors 508 include two sensors having the same sensor type. One of the two sensors is positioned on the interior surface and the other of the two sensors is positioned on the exterior surface. For example, in FIG. 5B, both the sensor 508-1 and the sensor 508-2 can be temperature sensors. The positioning of temperature sensors on both the interior and exterior surface of the drill bit 502 enables one to determine the temperature of the drilling fluid (e.g., drilling mud) before it enters the drill bit 502 after it exits the drill bit 502. By knowing these temperature values, one can calculate (e.g., determine) parameters such as frictional forces and heat generated by the frictional forces (e.g., by applying relations such as mass-momentum conservation energy in pipes).

In some implementations, the CT 408 and/or joint pipes 422 also include one or more sensors 510 (e.g., surface sensors) that can be positioned along (e.g., between) the surface 406 and a depth of the geothermal borehole 402. In some implementations, the surface sensors 510 can be positioned on the surface 406, on the CT injector 410, on the reel 412, and/or anywhere on the truck 414. The surface sensors 510, such as the sensors 510-1 to 510-4 as shown in FIG. 5A, measure surface data in-situ, as the geothermal boreholes are being drilled/constructed. In some implementations, the sensors 510 measure (e.g., collect) data such as fluid rate, pressure, temperature, and/or a length of the CT or joint pipe running into the borehole. In some implementations, the sensors 510 collect surface data having data types that are illustrated in FIG. 6.

In some implementations, the sensors 510 are positioned on both the interior surface and the exterior surface along the CT 402/joint pipes 422.

In some implementations, at least two of the sensors 510 have the same sensor type.

In some implementations, the sensors 510 include two sensors having the same sensor type. One of the two sensors is positioned on the interior surface along the CT 402/joint pipes 422, and the other of the two sensors is positioned on the exterior surface along the CT 402/joint pipes 422.

FIG. 6 illustrates exemplary types of surface data and downhole data that are collected by the sensors 508 and the sensors 510 in accordance with some implementations.

With continued reference to FIG. 5, in some implementations, the underground data collected by the sensors 508 and/or the sensors 510 can be transferred to the surface (e.g., to the geothermal planning and optimization system 200) automatically and in real-time using telemetry wires 512. The telemetry wires 512 also transfer power from the surface to the sensors 508 and/or the sensors 510. In some implementations, the telemetry wires 512 are associated with telemetry technologies such as electrical conduits or mud pulse telemetry, both of which are used for oil and gas CT operations. The electrical conduits (e.g., wires) have the dual advantage of being capable of much higher data transmission rates and being capable to also power to the underground sensors 508 (and to the surface sensors 510) from the surface. In the case of mud pulse telemetry, the underground sensors 508 would need to be powered by batteries, making the drill bits much bigger.

Figure 5C:
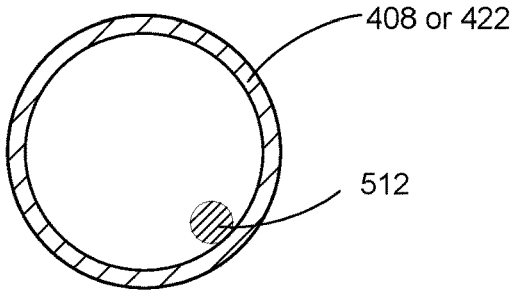

FIG. 5C is a cross-sectional view of a CT 408/joint pipe 422. In this example, the telemetry wire 512 is located on an internal wall (e.g., interior surface) of the CT 408/joint pipe 422.

Figure 5D:
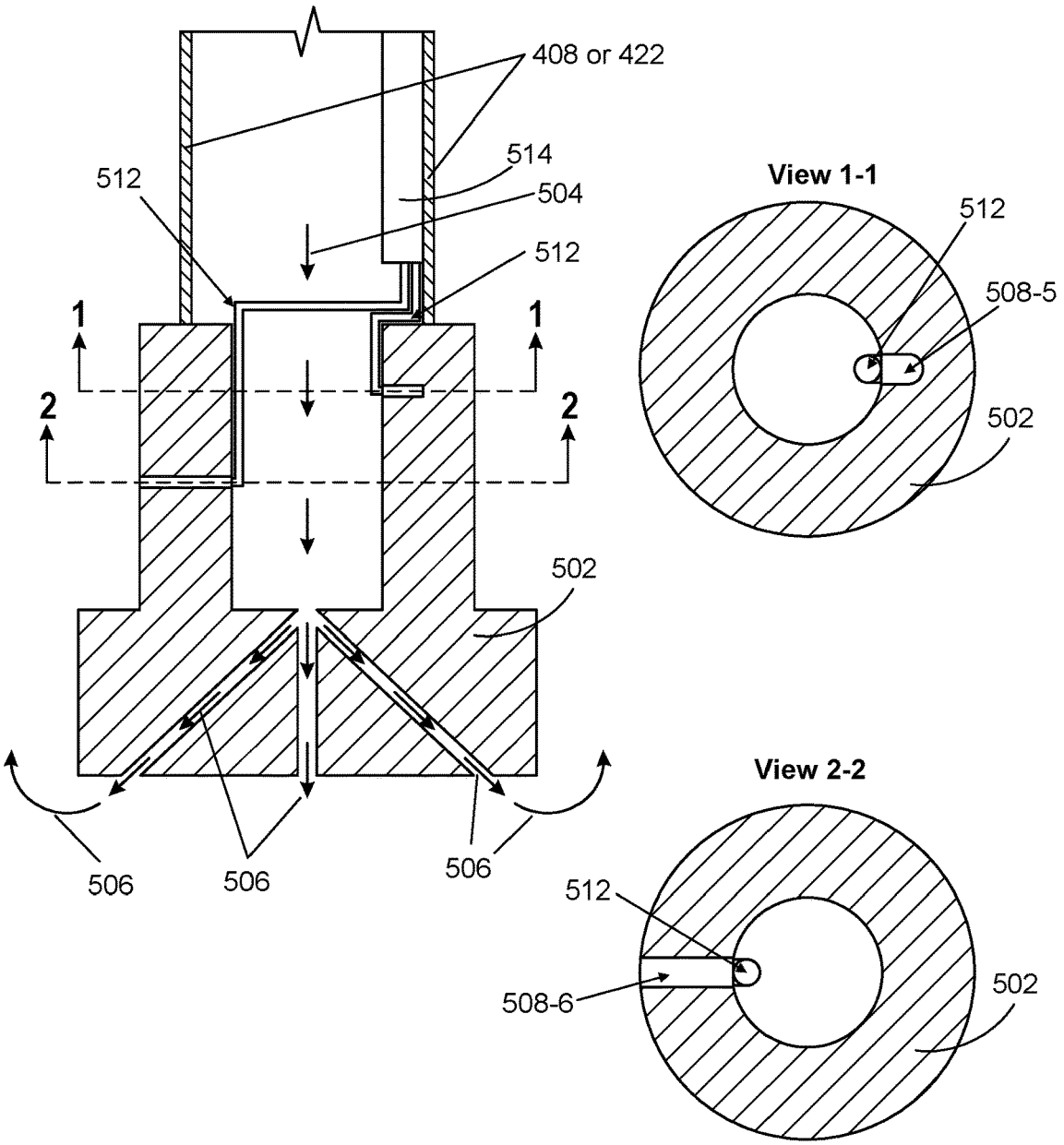

FIG. 5D is a cross-sectional view of the CT 408/joint pipe 422 and the drill bit 502, showing positions of the telemetry wire 512, a telemetry tube 514, and the flow directions 504 and 506 of the drilling fluid/drilling mud. The view in direction 1-1 shows the telemetry wire 512 positioned on the interior surface of the drill bit 502. The view in direction 1-1 also illustrates coupling (e.g., an electrical coupling, a communicative coupling) between the telemetry wire 512 and a sensor 508-5. In this example, the sensor 508-1 is an internal sensor (e.g., it is positioned on an interior surface of the drill bit 502). The view in direction 2-2 illustrates coupling (e.g., an electrical coupling, a communicative coupling) between the telemetry wire 512 and a sensor 508-6-5. In this example, the sensor 508-6 is an external sensor (e.g., it is positioned on an exterior surface of the drill bit 502).

Figure 7:
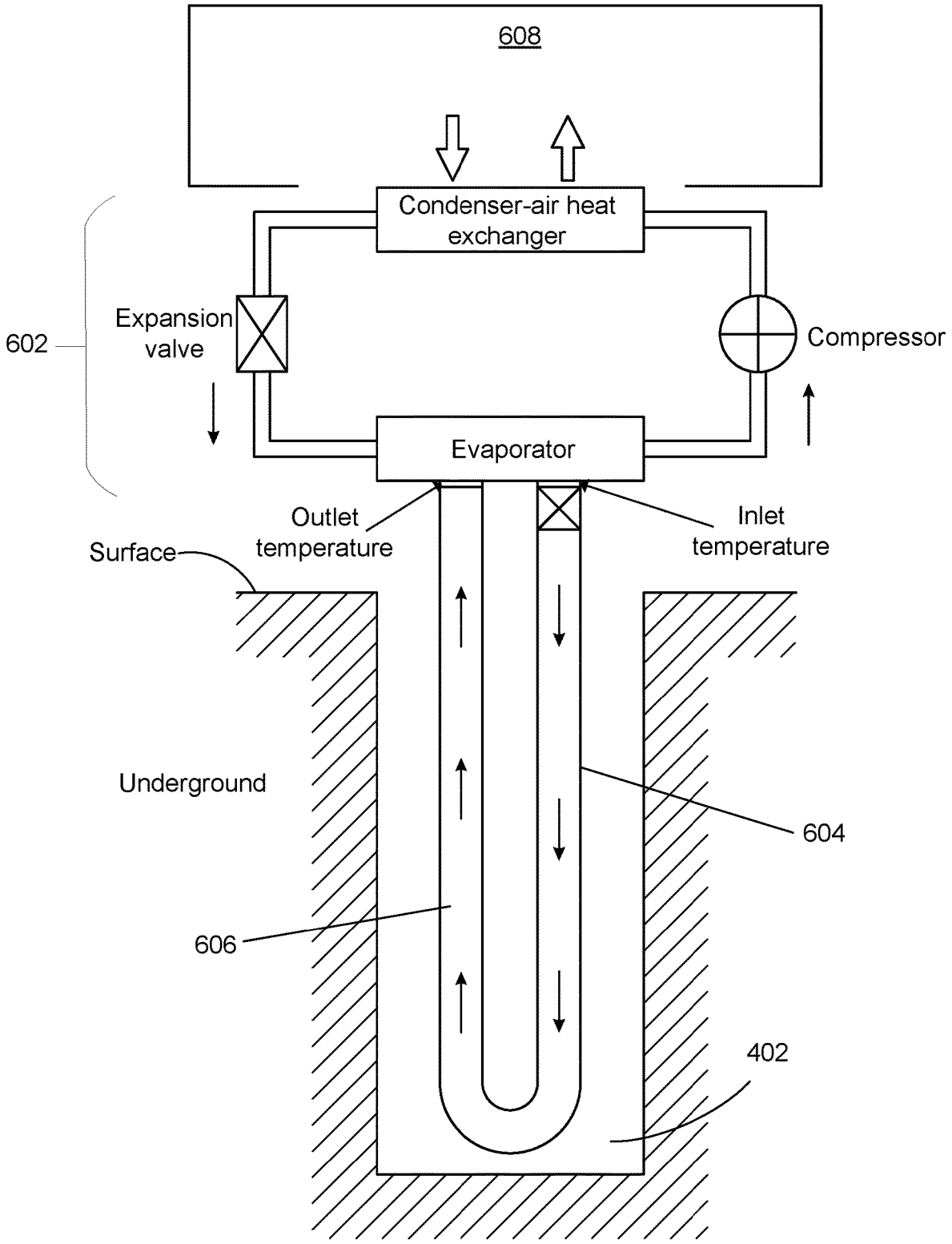
FIG. 7 illustrates a heat pump and a geothermal loop according to some implementations.

FIG. 7 illustrates a heat pump 602 and a geothermal loop 604 according to some implementations. In some implementations, the geothermal loop 604 is constructed from a geothermal borehole 402. The heat pump 602 uses the nearly constant temperature underground to heat or cool the interior of a building 608. The geothermal loop 604 is filled with a fluid 606 (e.g., a working fluid, such as a refrigerant) that circulates inside the geothermal loop 604. In summer, the surface air has a higher temperature compared to the underground temperature. The fluid 606 absorbs heat from the surface and releases it underground. In winter, the surface air has a lower temperature compared to the underground temperature. The fluid 606 absorbs heat from the underground and releases it to the surface. In some implementations, the heat pump 602 includes a reversing valve, which lets the heat pump 602 switch directions to either heat or cool the building.

Figure 8A:
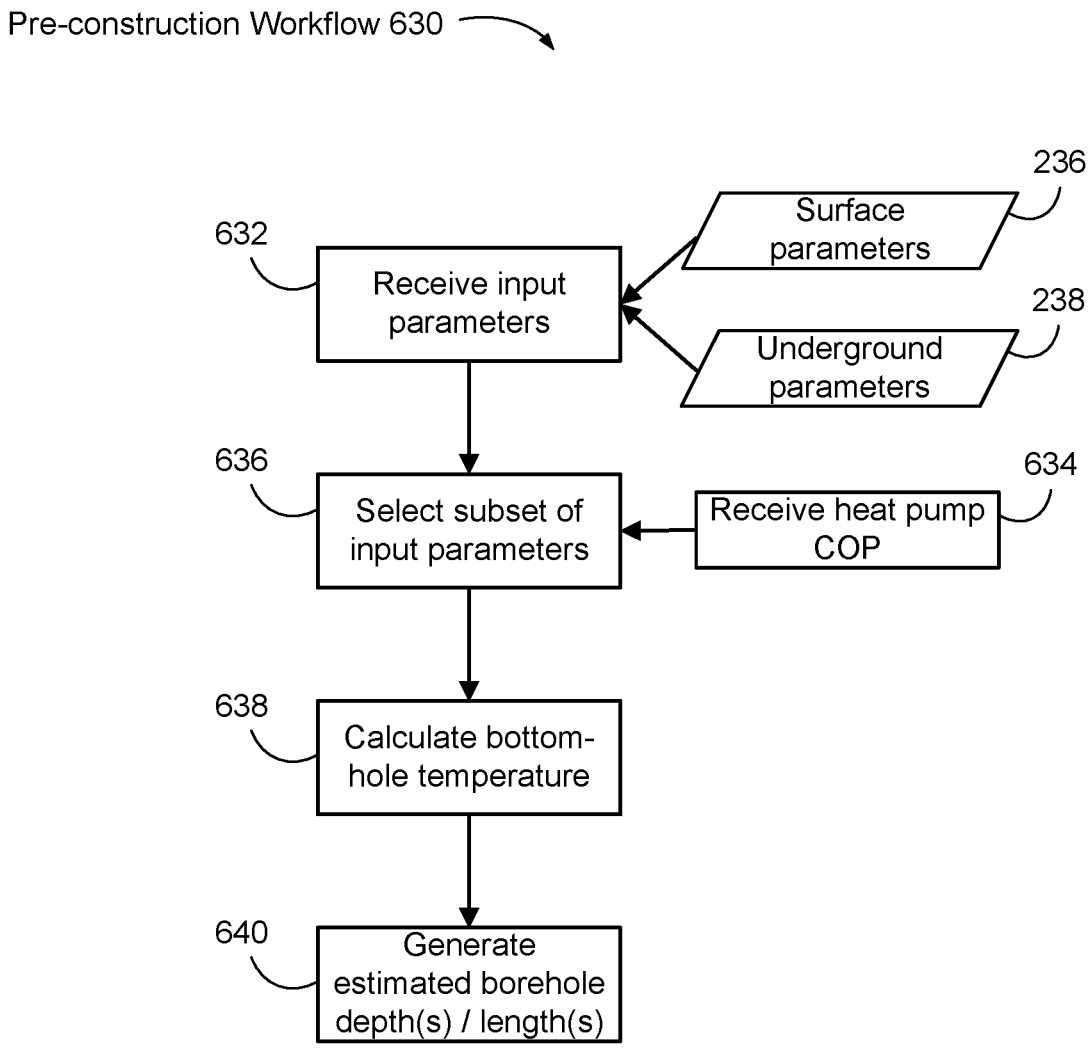
FIGS. 8A to 8C illustrate an integrated workflow for planning, constructing, and/or optimizing a GHCS operation, in accordance with some implementations.
Figure 8B:
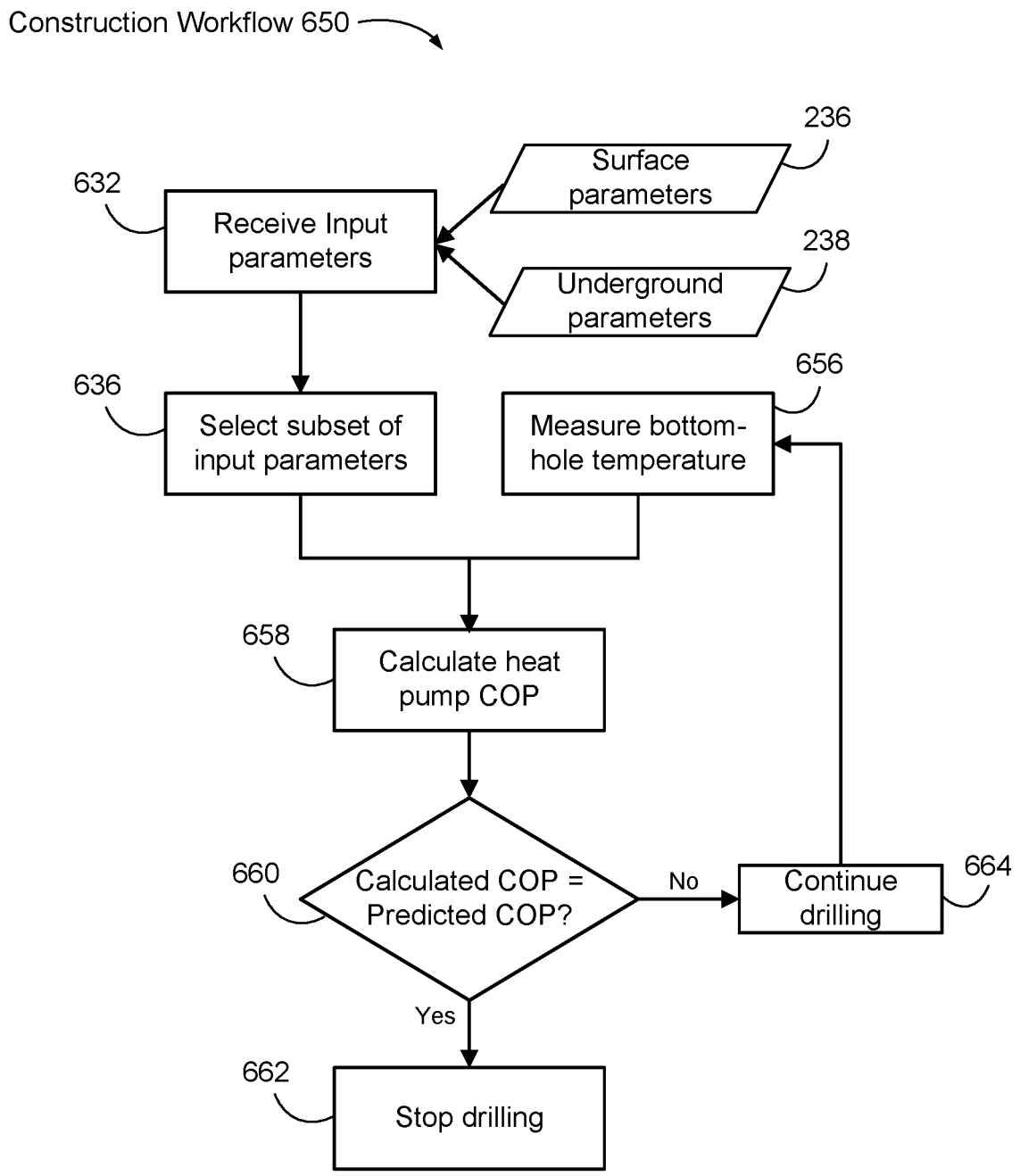
Figure 8C:
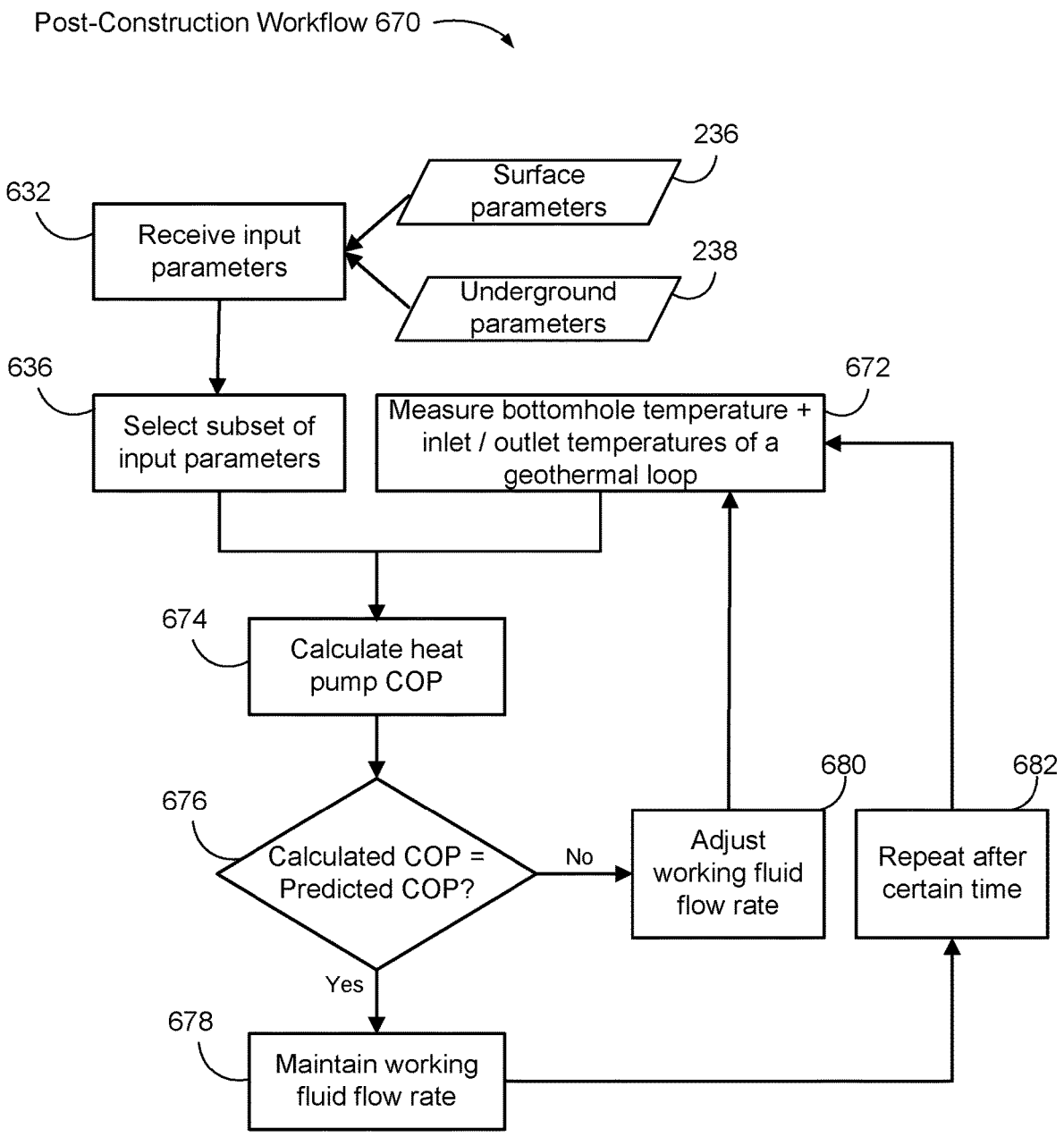
Figure 9A:
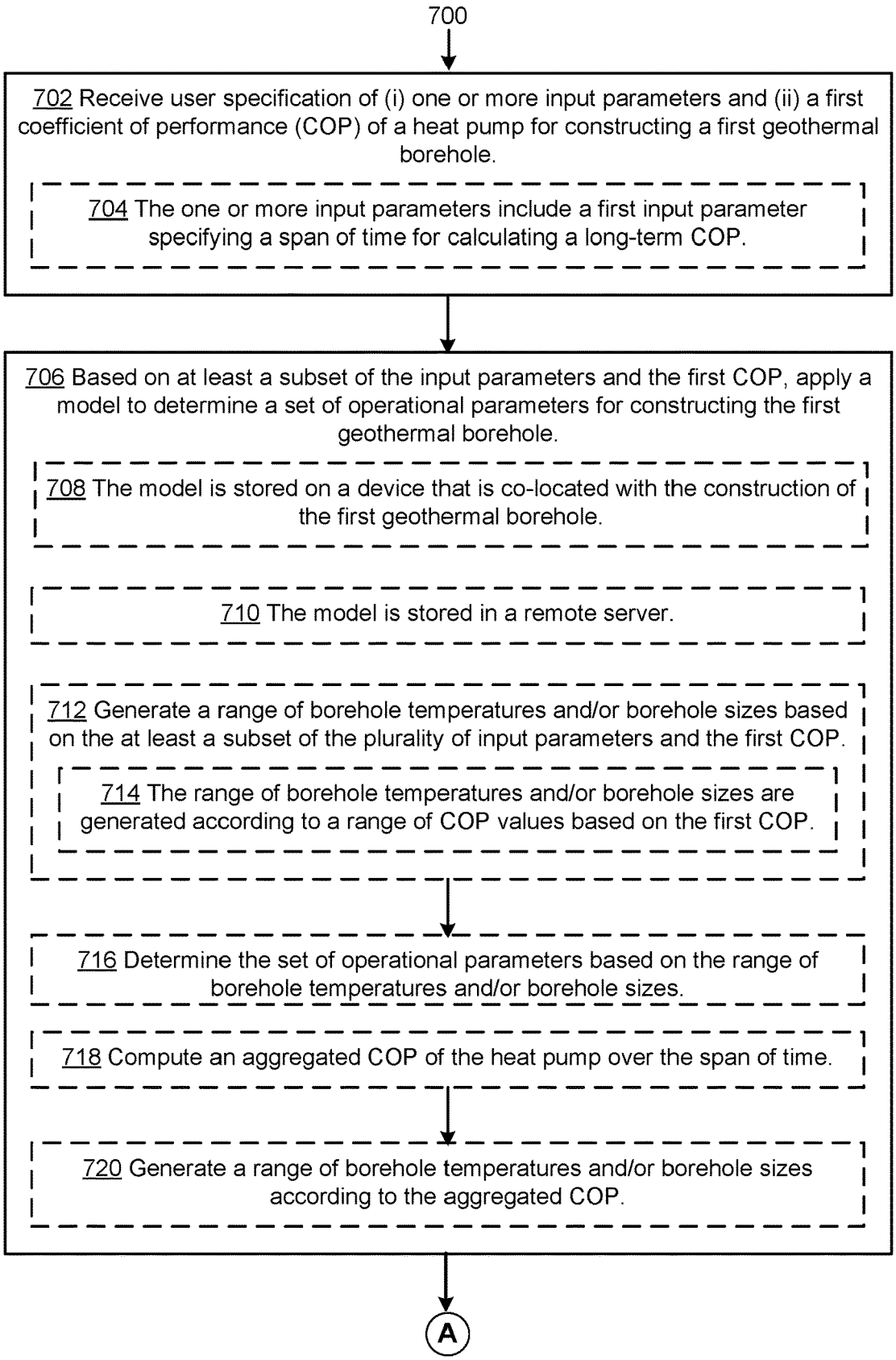
FIGS. 9A to 9D provide a flowchart of a method for optimizing a GHCS according to some implementations.
Figure 9B:
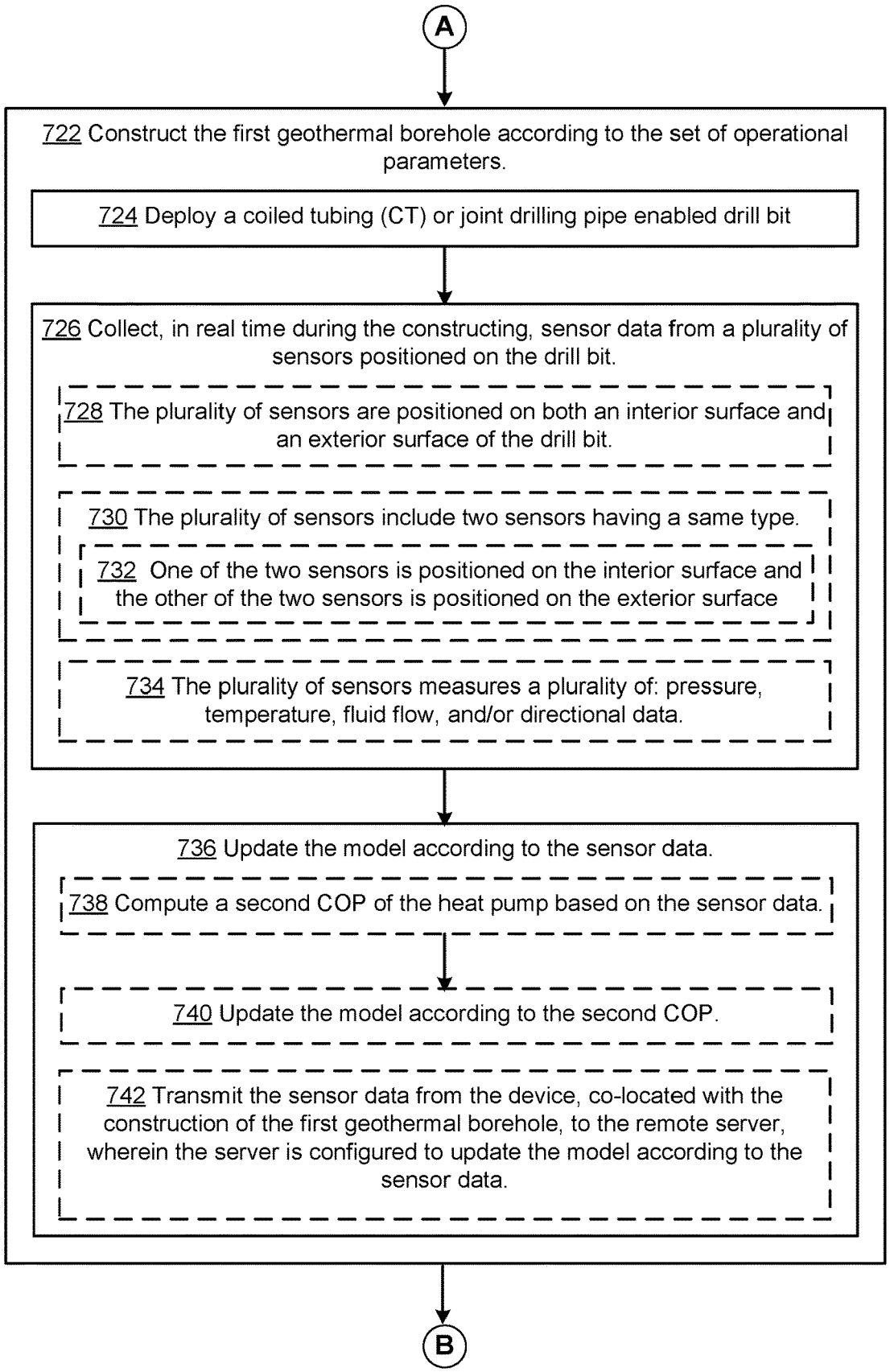
Figure 9C:
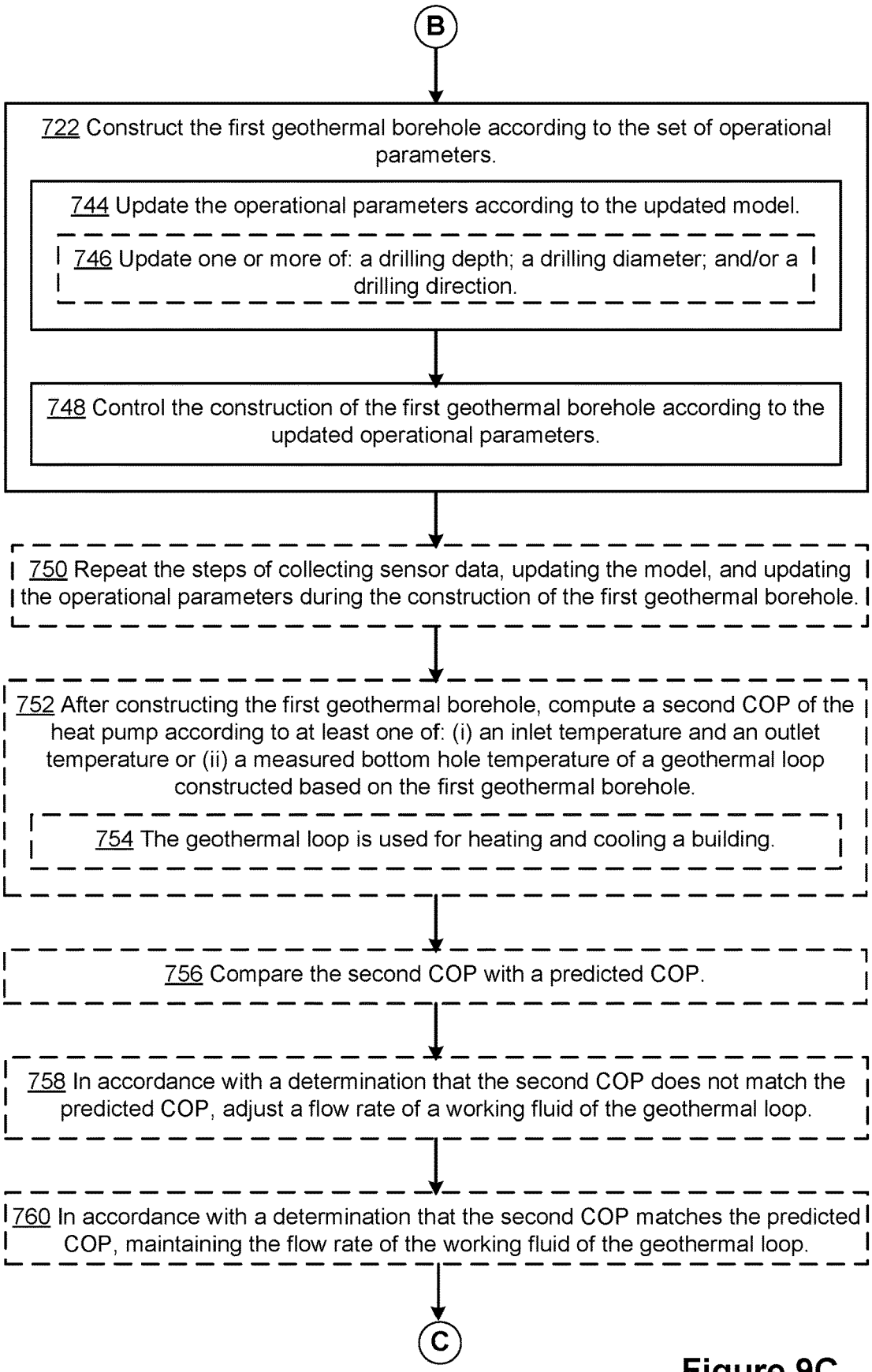
Figure 9D:
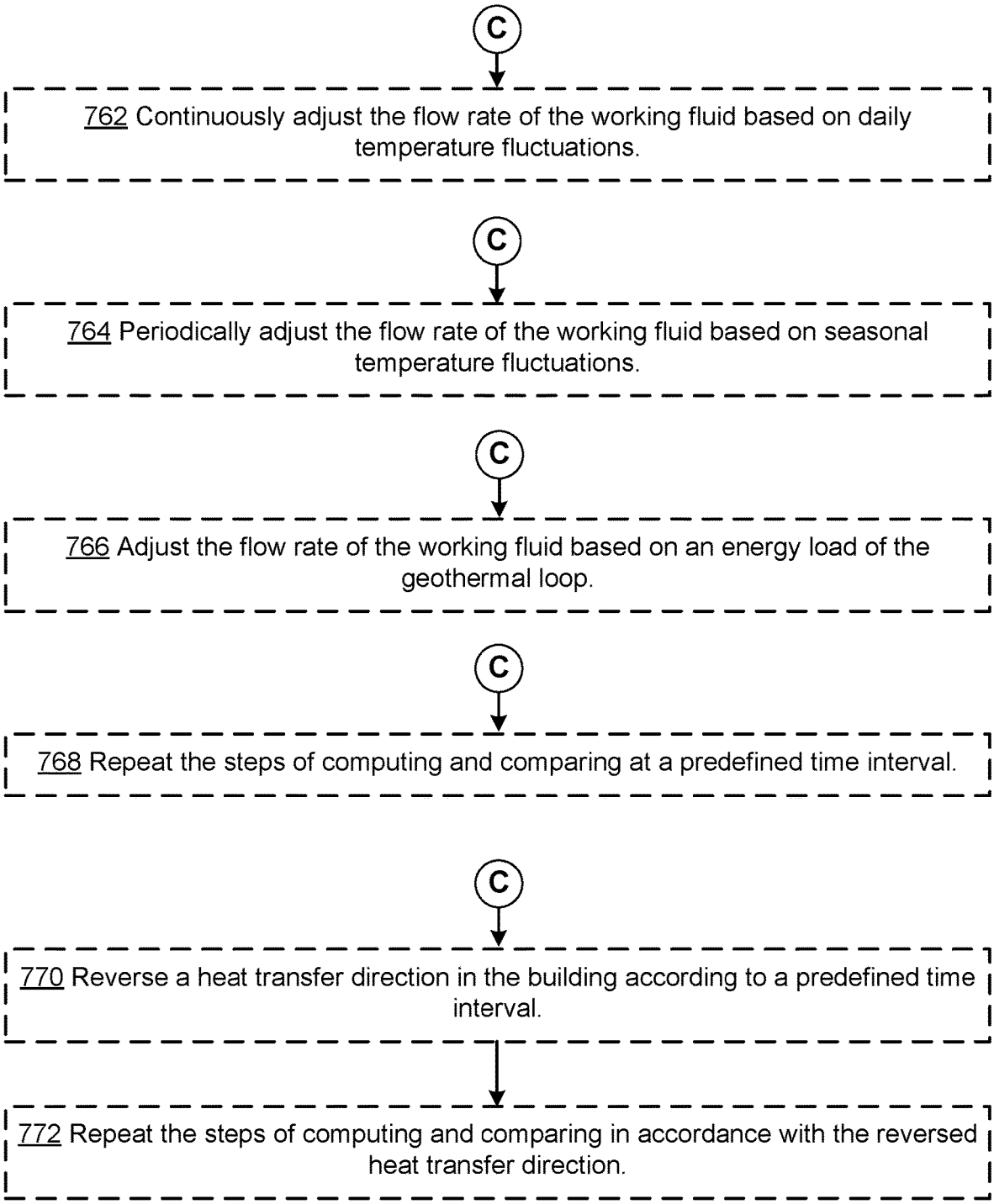

FIGS. 8A to 8C illustrate an integrated workflow (e.g., integrated workflow 628) for planning, constructing, and/or optimizing a GHCS operation, in accordance with some implementations. In some implementations, the workflow 628 includes a combination of one or more of: pre-construction workflow 630, a construction workflow 650, and a post-construction workflow 670. The workflows 630, 650, and 670 are executed by a processor (e.g., processor 202 or processor 302), in accordance with some implementations.

In some implementations, each of the workflows 630, 650, and 670 can be executed as a standalone workflow.

FIG. 8A illustrates a pre-construction workflow 630 that is executed by a processor (e.g., processor 202 or processor 302) during a pre-construction phase of a GHCS operation, according to some implementations.

The workflow 630 includes receiving (632) input parameters (e.g., specified by a user, the system 200, or the server 120). The input parameters can include surface parameters 236 and/or underground parameters 238. In some implementations, the input parameters include default (e.g., predefined) values that can be modified and/or overridden by a user.

The workflow 630 includes receiving (634) (e.g., from a user) a heat pump COP. In some implementations, the heat pump COP comprises a manufacturing COP of the heat pump as specified by the pump manufacturer. In some implementations (e.g., for large buildings), two or more heat pumps that work in tandem or independently may be used. The workflow 630 includes receiving respective heat pump COPs corresponding to each of the two or more heat pumps. In some implementations, in addition to (or instead of) receiving the heat pump COP, the workflow can measure heat transfer (e.g., directly, by measuring a temperature difference in an object) or indirectly, by calculation) and use the measured heat transfer as a proxy for determining the COP. For example, in some implementations, the workflow 630 includes measuring (or receiving) one or more temperatures of a geothermal fluid, such as an inlet and/or an outlet temperature. In some implementations, the workflow 630 includes measuring (or receiving) a heat transfer coefficient of the heat between a subsurface and a geothermal borehole.

The workflow 630 includes selecting (636) (e.g., by the processor), or receiving user selection of, a subset of input parameters. The workflow 630 includes calculating (638) a bottom-hole temperature of a geothermal borehole to be constructed, based on the selected subset of input parameters. The workflow 630 includes generating (640) (e.g., by the processor, by applying the model 126) estimated borehole parameters, such as the borehole depth, length, and/or diameter.

In some implementations, in accordance with receiving the heat pump COP in step 634, the processor generates a range of COP values (e.g., by applying the model 126), to obtain a range of borehole parameters, which in turn facilitates a builder to properly design and plan the drilling job, obtain the right drilling permits, and/or for plan the geothermal loops for an optimal long-term underground heat transfer process.

In some implementations, execution of the workflow 630 provides (e.g., generates) operational parameters of one geothermal borehole. In a construction that involves multiple boreholes, the workflow 630 is executed repeatedly, each of the iterations generating a set of borehole parameters for a respective borehole.

FIG. 8B illustrates a construction workflow 650 that is executed by a processor (e.g., processor 202 or processor 302) during the construction phase of a GHCS operation, according to some implementations. In some implementations, the workflow 650 includes the step 632 and the step 636 as described previously with respect to FIG. 8A.

In some implementations, the workflow 650 includes, in step 656, measuring (e.g., by one or more sensors) the bottom-hole temperature of a geothermal borehole during the construction of the borehole. For example, as illustrated in FIGS. 5B and 5D, sensors 508 can be mounted on a drill bit 502 that is used for drilling a geothermal borehole. In some implementations, the sensors 508 include temperature sensors for measuring (e.g., automatically and in real time) a bottom-hole temperature as the geothermal borehole is being drilled. In some implementations, the workflow 650 includes measuring surface and downhole conditions (e.g., pressure, temperature, and/or flow rate) during the construction of the borehole, from surface sensors (e.g., sensors 510) and underground sensors (e.g., sensors 508).

In some implementations, the workflow 650 includes, in step 658, calculating (e.g., by the processor) the heat pump COP based on the selected subset of input parameters and the measured bottom-hole temperature. For example, the processor updates the model 126 based on the measured bottom-hole temperature, and applies the updated model to determine a calculated (e.g., actual, modified) heat pump COP.

In some implementations, the workflow 650 includes comparing (660) the calculated COP with a predicted COP (e.g., predicted by the model 126 or a machine learning database 130). The workflow 650 includes, in step 662, terminating the drilling process when the calculated COP matches the predicted COP. The workflow 650 includes, in step 644, continuing the drilling of the geothermal borehole (e.g., drilling deeper, varying a drilling angle and/or a borehole diameter) when the calculated COP does not match the predicted COP.

Stated another way, the downhole sensors (e.g., sensors 508) encased in the drill bit 502 allow re-calibration of the model 126 in real time. That is, actual temperature data is acquired in real time during drilling, which changes the output of initial design model dynamically. This empowers the field personnel to optimize the operational parameters on-the-fly, e.g., drilling shorter, longer, or wider wells to ensure the optimal performance of each GHCS installation.

FIG. 8C illustrates a post-construction workflow 670 that is executed by a processor (e.g., processor 202 or processor 302) during the post-construction phase of a GHCS operation, according to some implementations. In some implementations, the workflow 670 includes the step 632 and the step 636 as described previously with respect to FIG. 8A.

In some implementations, the workflow 670 includes, in step 672, measuring the bottom-hole temperature (e.g., of a borehole or a geothermal loop) and an inlet/outlet temperature of a geothermal loop (e.g., geothermal loop 604). In some implementations, after the geothermal borehole 402 has been constructed, an optical fiber is placed inside the constructed borehole, for collecting the temperature along a geothermal loop constructed based on the borehole. In some implementations, the bottom-hole temperature is determined indirectly via calculations (e.g., solving a loop-pipe flow thermodynamic equation, or determining a temperature profile along the geothermal loop loop).

In some implementations, the workflow 670 includes, in step 674, calculating a heat pump COP. The workflow 670 includes. in step 676, comparing the calculated COP with a predicted COP (e.g., predicted by the model 126). The workflow 670 includes, in step 678, maintaining a current flow rate of a working fluid in the geothermal loop when the calculated COP matches the predicted COP. The workflow 670 includes, in step 680, adjusting the flow rate of the working fluid in the geothermal loop when the calculated COP does not match the predicted COP.

In some implementations, the workflow 670 includes, in step 682, repeating the measuring and calculating (e.g., steps 672, 674, and 676) after a certain time (e.g., every month, every three months, every year, or every change of season), and maintaining or adjusting the flow rate of the working fluid accordingly.

In a geothermal system, heat exchange occurs (1) between the geothermal loop and the building and (2) between the geothermal loop and the near constant-temperature thermal reservoir from the underground rocks. The underground heat transfer process between the working fluid 606 and the underground rocks (e.g., the underground region surrounding the geothermal loop) can be calculated by solving a radial (i.e., one-dimensional) diffusion equation in the near-borehole region (e.g., 10 to 30 feet radially from the borehole). The initial temperature of the near-borehole region is different from the long-term pseudo-steady-state temperature of the same region. The temperature of the near-borehole region changes over time due to several reasons. First, for heating, the working fluid picks up heat from the underground rocks and brings it to the surface, so the inlet temperature of the geothermal loop (see, e.g., FIG. 7) is lower than the outlet temperature of the geothermal loop. If the fluid is continuously circulated, heat is produced from the underground, so the temperature in the near-borehole region decreases over time until it reaches a pseudo-steady-state temperature, which is lower than the initial underground temperature. On the other hand, for cooling, the working fluid loses heat to the underground rocks, so the inlet temperature of the geothermal loop is higher than the outlet temperature of the geothermal loop. If the fluid is continuously circulated, heat is lost to the underground, so the temperature in the near-borehole region increases over time until it reaches a pseudo-steady-state temperature, which is higher than the initial underground temperature. Stated another way, because the pseudo-steady-state temperature of the near-borehole region is expected to vary from the initial temperature when the geothermal loop is first installed, the working fluid flow rate may need to be adjusted over time to ensure optimal long-term performance of the GHCS.

FIGS. 9A to 9D provide a flowchart of a method 700. The method 700 is also called a process. The method 700 is performed at a geothermal planning and optimization system 200 (e.g., a computing device, a computer system) that has one or more processors 202 and memory 206. The memory 206 stores one or more programs configured for execution by the one or more processors 202. In some implementations, the operations shown in FIGS. 1, 4A, 4B, 5A to 5D, 6, 7, and 8A to 8C correspond to instructions stored in the memory 206 or other non-transitory computer-readable storage medium. The computer-readable storage medium may include a magnetic or optical disk storage device, solid state storage devices such as Flash memory, or other non-volatile memory device or devices. The instructions stored on the computer-readable storage medium may include one or more of: source code, assembly language code, object code, or other instruction format that is interpreted by one or more processors. Some operations in the method 700 may be combined and/or the order of some operations may be changed.

The system 200 receives (702) user specification of (i) one or more (e.g., a plurality of) input parameters (e.g., input parameters 234) and (ii) a first coefficient of performance (COP) (or energy efficiency ratio (EER)) of a heat pump for constructing a first geothermal borehole (e.g., geothermal borehole 402, a borehole heat exchanger). In some implementations (e.g., for large buildings), a GHCS system may include two or more heat pumps that work independently on in tandem. The system 200 may receive user specification of respective COPs for the two or more heat pumps.

The COP measures the efficiency of a heating, ventilating, and air conditioning (HVAC) pump (e.g., heat pump) that is used for heating. The EER measures the efficiency of an HVAC pump that is used for cooling. As used herein, "COP" is used here to denote heating and/or cooling operations. The implementations disclosed herein apply to both COP (e.g., heating) and EER (e.g., cooling).

In some implementations, the plurality of input parameters includes surface input parameters (e.g., surface parameters 236). The surface input parameters can include parameters for: building size, building type (e.g., wall material and insulation of the building, roof type, the number of windows in the building, window size(s), window orientation(s) (e.g., whether the windows face the sun)), energy load of the building, the HVAC system used, the location of the building, heat pump size, heat pump type, thermal efficiency of the heat pump, inlet and outlet temperatures of geothermal loop(s) associated with the building, the outdoor temperature, and/daily and seasonal temperature ranges.

In some implementations, the plurality of input parameters includes underground parameters (e.g., underground parameters 238). The underground input parameters can include parameters for: fluid type (e.g., fluid density and/or viscosity), geothermal pipe roughness, inlet temperatures of the geothermal loop(s), length (e.g., depth) of the geothermal loop, the size (e.g., diameter) of the geothermal loop, the trajectory of the geothermal loop (e.g., whether the geothermal loop is vertical, horizontal, deviated, or inclined), geothermal loop material and/or their heat transfer coefficient(s), underground pressure, temperature, rock type, aquifer depth and height, grout/cement/casing heat transfer coefficients, and/or geothermal working fluid flow rate.

In some implementations, the one or more input parameters include (704) a first input parameter specifying a span of time (e.g., 1 year, 5 years, or 10 years) for calculating a long-term COP. For example, as explained with respect to FIG. 8C, the pseudo-steady-state temperature of a near-borehole region of a geothermal loop is likely different from its initial temperature, when the geothermal loop is first installed, because of heat exchange between both the geothermal loop and the building and the geothermal loop and the near constant-temperature thermal reservoir from the underground rocks.

The system 200 applies (706) a model (e.g., model 126) based on at least a subset of the input parameters and the first COP, to determine (e.g., calculate, output, predict) a set of operational parameters for constructing (e.g., drilling) the first geothermal borehole.

In some implementations, the subset of the input parameters can be selected by the user, or by the system 200, or a combination thereof.

In some implementations, the set of operational parameters includes the borehole size, the borehole depth (and temperature), the borehole length, and/or the angle (inclination) of the borehole.

In some implementations, the system 200 is co-located with the first geothermal borehole construction operation. The model is stored (708) locally on the system 200.

In some implementations, the model is stored (710) on a remote server (e.g., server system 120). For example, in some implementations, at least a subset of the modeling and/or analytics are performed remotely by the server system 120 (e.g., remote from the GHCS construction and operation sites). In some implementations, the modeling and/or analytics are performed simultaneously (e.g., in parallel) by a plurality of systems 200 and/or the server system 120.

In some implementations, applying the model to determine the set of operational parameters includes generating (712) (e.g., predicting) (e.g., by the one or more processors 202) a range of borehole temperatures and/or borehole sizes (e.g., borehole lengths, depths, and/or diameters) based on the at least a subset of the plurality of input parameters and the first COP.

In some implementations, the range of borehole temperatures and/or borehole sizes are generated according to (714) a range of COP values based on (e.g., that includes) the first COP.

For example, as discussed with respect FIG. 8A, in some implementations, in accordance with receiving the heat pump COP in step 634, the system 200 can generate a range of COP values (e.g., by applying the model 126) to obtain a range of borehole parameters, which facilitate proper design and planning of the drilling job, getting the right drilling permits, and/or for planning the geothermal loops for an optimal long-term underground heat transfer process.

In some implementations, the system 200 determines (716) the set of operational parameters based on the range of borehole temperatures and/or borehole sizes.

In some implementations, applying the model to determine the set of operational parameters includes computing (718) an aggregated COP (e.g., a long-term COP) of the heat pump over the span of time and generating (720) (e.g., predicting) a range of borehole temperatures and/or borehole sizes according to the aggregated COP.

The system 200 constructs (722) (or causes construction of) the first geothermal borehole according to the set of operational parameters.

In some implementations, the system 200 deploys (724) a CT or joint drill pipe enabled drill bit. For example, as illustrated in FIGS. 4A-5D, in some implementations, the system 200 deploys a drill bit 502 that is mounted on one end of a CT 408 or mounted on one end of a joint pipe 422, for performing a geothermal well drilling operation using the CT or joint drill pipes. The well drilling operation creates an underground borehole (e.g., from scratch), or enlarges and/or extends an existing borehole.

The system 200 collects (726) (e.g., measures), in real time during the constructing (e.g., automatically, and without user intervention), sensor data (e.g., sensor data 244, downhole conditions) from a plurality of sensors (e.g., sensors 508) positioned on the drill bit while the CT operation and/or drilling operation using joint drill pipes or CT is being performed. In some implementations, the system 200 collects sensor data (e.g., downhole data and surface data, such as pressure, temperature, and/or flow rate) from both the underground sensors 508 and the surface sensors 510 when drilling. In some implementations, the system measures the CT/joint drill pipe length in hole when drilling, as a raw estimate of the borehole depth. In some circumstances, the CT is not straight in the hole and can buckle if pushed too hard, but this can be modeled using solid mechanics/tensile force analysis.

In some implementations, the sensors are positioned (728) on both the interior surface and the exterior surface of the drill bit. This is illustrated in FIGS. 5A, 5B, and 5D. For example, in some implementations, the sensors are positioned such that they contact the drill cutting fluid on both the interior and exterior surfaces of the drill bit 502, thereby enabling the system to determine the temperature of the drilling fluid (before it enters the drill bit 502 after it exits the drill bit 502, and to determine (e.g., calculate) drilling parameters such as frictional forces and heat generated by the frictional forces In some implementations, the sensors include (730) two sensors having the same type (e.g., two temperature sensors or two pressure sensors). One of the two sensors is (732) positioned on the interior surface and the other of the two sensors is positioned on the exterior surface. This is illustrated in FIG. 5B.

In some implementations, the sensors measure (734) a plurality of: pressure, temperature, fluid flow, and/or directional data (e.g., inclination or azimuth). For example, FIG. 6 illustrates the exemplary types of data that are measured (e.g., collected) by the sensors.

The system 200 updates (736) (e.g., in real time, automatically, and without user intervention) the model according to the sensor data.

In some implementations, updating the model according to the sensor data includes computing (738) a second COP (e.g., an updated COP) of the heat pump based on the sensor data and/or based on the at least a subset of the plurality of parameters), and updating (740) the model according to the second COP.

For example, as illustrated in steps 656, 658, 660, 662, and 664 in FIG. 8B, the system 200 computes a heat pump COP (step 658 in FIG. 8B) based on the bottom-hole temperature measured by the sensors 508 and/or the sensors 510, and updates the model 126 (e.g., whether to continue drilling or to stop drilling) according to the computed heat pump COP.

In some implementations, the model 126 is stored on the remote server (e.g., the server system 120). Updating the model according to the sensor data includes transmitting (742) the sensor data from the system 200 to the server. The server is configured to update the model according to the sensor data.

The system 200 updates (744) the operational parameters according to the updated model.

In some implementations, updating the operational parameters includes updating (746) one or more of: the drilling depth, the drilling diameter, and/or the drilling direction.

The system 200 controls (748) (e.g., modifies or adjusts operational parameters) (e.g., in real time) the construction of the first geothermal borehole according to the updated operational parameters. Stated another way, in contrast to existing geothermal wells that are constructed using predetermined dimensions (e.g., lengths and/or depths that are pre-determined), the actual dimensions of the first geothermal borehole may vary from its initial dimensions, depending on the underground conditions that are determined as the drilling/construction operation is carried out.

In some implementations, the system 200 repeats (750) the steps of collecting, updating, and controlling during the construction of the first geothermal borehole.

In some implementations, after the first geothermal borehole is constructed, the system 200 computes (752) a second COP of the heat pump according to at least one of: (i) an inlet temperature and an outlet temperature or (ii) a bottom hole temperature of a geothermal loop constructed based on the first borehole.

In some implementations, the bottom hole temperature is measured directly. For example, a sensor (e.g., a single point sensor) can be placed inside the first geothermal borehole for measuring the bottom hole temperature. In some implementations, during or after construction of the first geothermal borehole, an optical fiber is placed inside the first geothermal borehole for collecting the temperature along the geothermal loop constructed based on the first borehole. In some implementations, the bottom hole temperature is determined indirectly via calculations (e.g., solving a loop-pipe flow thermodynamic equation, or determining a temperature profile along the geothermal loop).

In some implementations, the system 200 compares (756) the second COP with a predicted COP (e.g., the first COP, or a COP value that is calculated during first borehole construction).

In some implementations, in accordance with a determination that the second COP does not match the predicted COP, the system 200 adjusts (758) the flow rate of a working fluid of the geothermal loop.

In some implementations, in accordance with a determination that the second COP matches the predicted COP, the system 200 maintains (760) the flow rate of the working fluid of the geothermal loop.

In some implementations, the GHCS operation includes constructing multiple boreholes. The method 700 comprises constructing the first borehole and computing the second COP of the heat pump after constructing the first geothermal borehole, prior to commencing construction of a second borehole. In some implementations, constructing the second borehole comprises repeating the steps for constructing the first borehole. In some implementations, the operational parameters for constructing the second borehole take into consideration the second COP of the first borehole.

In some implementations, the system 200 continuously adjusts (762) (e.g., once every hour or once every three hours) the flow rate of the working fluid based on daily temperature fluctuations.

In some implementations, the system 200 periodically adjusts (764) (e.g., once per month or once every three months) the flow rate of the working fluid based on seasonal temperature fluctuations.

In some implementations, the system 200 adjusts (766) the flow rate of the working fluid based on the energy load of the geothermal loop.

In some implementations, the system 200 repeats (768) the steps of computing and comparing at a predefined time interval.

In some implementations, the method 700 further comprises reversing (770) (e.g., changing, switching) the heat transfer direction (e.g., ground to building or building to ground) in the building according to a predefined time interval (e.g., change in season or month of the year). The system 200 repeats (772) the steps of computing and comparing in accordance with the reversed heat transfer direction (so as to ensure optimal COP during the flow direction reversal).

Each of the above identified executable modules, applications, or sets of procedures may be stored in one or more of the previously mentioned memory devices, and corresponds to a set of instructions for performing a function described above. The above identified modules or programs (i.e., sets of instructions) need not be implemented as separate software programs, procedures, or modules, and thus various subsets of these modules may be combined or otherwise re-arranged in various implementations. In some implementations, the memory 206 stores a subset of the modules and data structures identified above. Furthermore, the memory 206 may store additional modules or data structures not described above.

A. Coiled Tubing Drilling for Geothermal Heating and Cooling Operations

Some aspects of the present disclosure are directed to coiled tubing (CT) drilling technology for constructing geothermal boreholes.

As described above, current drilling technologies for geothermal and hydrocarbon well construction are divided between (Category A) small drilling rigs for shallow water or geothermal wells (e.g., 100 to 400 feet long vertical (e.g., deep) wells, and (Category B) large drilling rigs for deep oil & gas and conventional geothermal wells (e.g., 10,000 to 30,000 feet long vertical wells). No off-the-shelf drilling rig exists commercially for mid-range-length wells that are between 500 and 10,000 feet deep. Therefore, no off-the-shelf drilling rig has been developed for this range, leaving a technology gap between Categories A and B. While shallow water well drilling rigs (Category A) are small and portable enough to be transported and operated in high-density urban areas, they do not go very deep and are not very fast. The deep oil and gas rigs (Category B) are fast and powerful, but also large and heavy, and are meant to operate in remote areas far from urban/suburban development. This leaves a gap for fast and strong, yet compact and portable drilling rigs that can operate in urban/suburban/rural areas.

In addition to the technology gap for mid-range length geothermal wells, several constraints exist when it comes to constructing geothermal boreholes in urban (e.g., high-density), suburban, and, or commercial areas. These include space limitations, weight limitations (e.g., the drill rig needs to be transported to and from the construction site via paved concrete roads), and noise generated during well construction.

According to some implementations of the present disclosure, a system (e.g., a drill rig) for drilling geothermal boreholes includes a CT reel for spooling a CT string. The system includes an injector (e.g., CT injector) and a gooseneck for injecting the CT string from the surface into the subsurface to construct a geothermal borehole. In some implementations, the injector and the gooseneck are supported by a mast having an adjustable length (e.g., height). In some implementations, the system includes adjustable arms (e.g., telescopic arms) for supporting (e.g., coupling) the CT reel and the injector to a chassis (e.g., a main frame) of the system.

As disclosed herein, in some implementations, prior to borehole construction, the system adjusts the arms and/or the mast (e.g., by varying the length of a respective arm, varying the angle formed between a respective arm and the CT reel, and/or varying the angle formed between the respective arm and the injector, and/or a height of the mast) to place the CT reel, the injector, and the mast in their respective "operational positions." In some implementations, the respective operational positions of the CT reel, the injector, and the mast are determined according to the depth of the borehole to be constructed, the size (e.g., diameter) of the CT string, the length of the CT string, and the subsurface terrain in which the geothermal hole is constructed. After the CT reel, the injector, and the mast have been placed in their respective operational positions, the system commences borehole construction.

As disclosed herein, during operation (e.g., during borehole construction), the distance between the CT rig and the injector (e.g., a distance between the CT rig and the gooseneck) can be adjusted (e.g., dynamically) by varying the length of the respective arm, the angle formed between the respective arm and the CT reel, the angle formed between a respective arm and the injector, and/or the height of the mast. In some implementations, the distance between the CT rig and the injector (or the distance between the CT rig and the gooseneck) is adjusted based on the CT diameter, wall thickness, material, and/or length.

According to some implementations of the present disclosure, the system deploys a CT enabled drill bit that is fitted with sensors to construct a geothermal borehole. The sensors collect (e.g., in real time, automatically and without user intervention, during the constructing) sensor data from sensors that are positioned on the drill bit and/or at the surface.

In some implementations, the sensor data include force, torque, and/or vibration data.

In some implementations, the system uses the sensor data to determine (e.g., monitor) the drilling speed, the drilling force (e.g., the force and/or torque exerted on the drill bit), and the force/torque on the CT string (e.g., before the CT string enters the injector, after the CT string leaves the injector, and when the CT string is injected into the subsurface). For example, the system determines, based on the measured forces in the CT itself, whether the CT is straight or in a helical shape.

As disclosed herein, when the system is not in use (e.g., before borehole construction, after borehole construction and/or during transportation), the system adjusts the arms and/or the mast (e.g., by varying the length of the respective arm, the angle formed between the respective arm and the CT reel, the angle formed between the respective arm and the injector, and/or the height of the mast) to place the CT reel, the injector, and the mast in their "rest positions." In some implementations, the "rest positions" corresponds to a compact configuration of the drill rig which facilitates transportation of the drill rig on city streets.

The system disclosed herein advantageously improves geothermal borehole construction. For example, a requirement for current drillers (e.g., in a city) is that they have to map/verify that the constructed boreholes are vertical. Because current geothermal borehole construction technologies do not incorporate built-in sensors, the industry practice is to drill about 100 feet every time, insert a wireline (e.g., a wire with sensors) to measure and confirm that the geothermal borehole is (e.g., still) in the direction the drillers believe the borehole should be, drill another approximately 100 feet, and repeat the measurement process. In contrast to the existing systems, the disclosed system includes sensors positioned on (and/or within) the drill bit, thereby enabling the system to continuously monitor the drilling and intervene if needed.

1. CT Rig

Figure 10A:
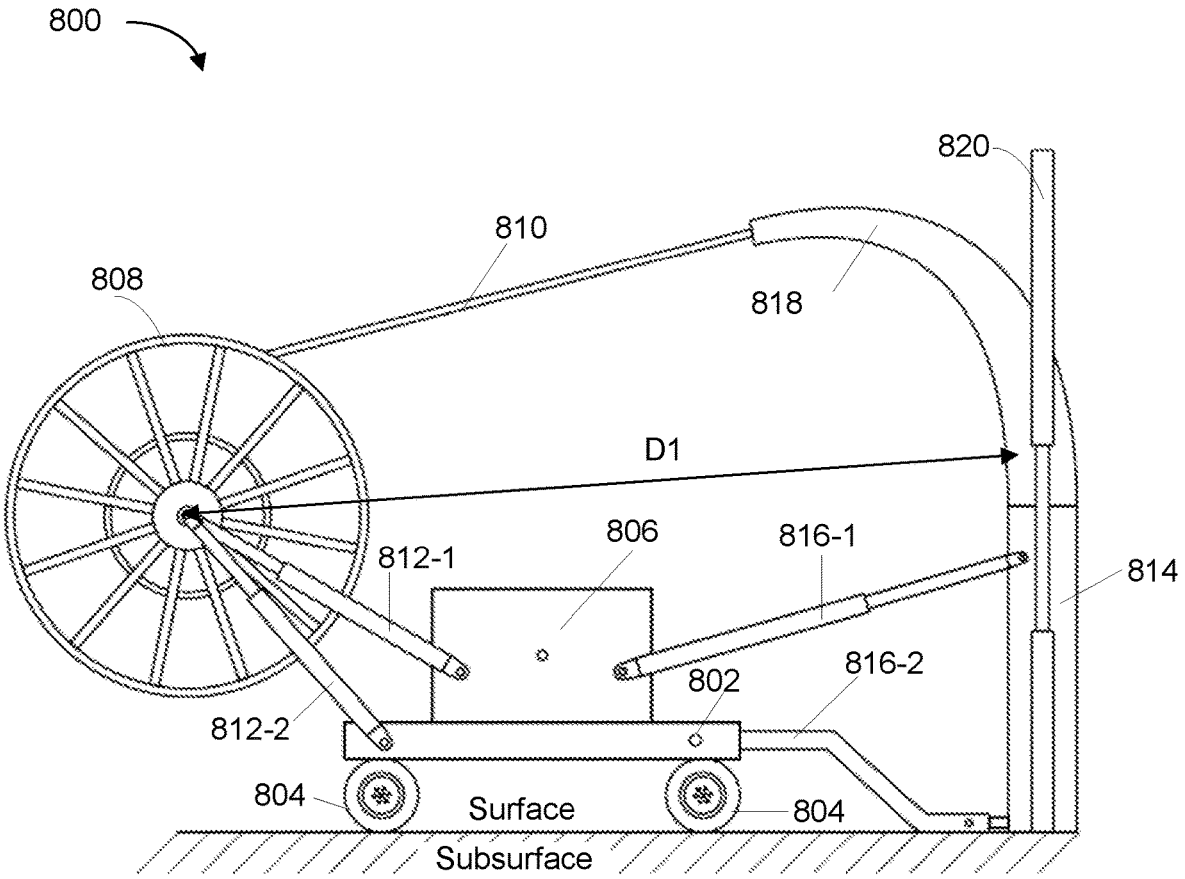
FIGS. 10A and 10B illustrate a CT rig according to some implementations.

FIG. 10A illustrates a CT rig 800 (e.g., a system) according to some implementations. In some implementations, FIG. 10A is a representative view of the CT rig when it is in operation.

In some implementations, the CT rig 800 includes a chassis 802 with wheels 804 (e.g., crawler).

The CT rig 800 includes a power (e.g., power and hydraulics) unit 806 that is mounted on the chassis 802.

The CT rig 800 includes a CT reel 808 for spooling (e.g., winding) a CT string 810 (e.g., a pipe) that includes a continuous length. The CT string 810 can include a length that is predefined according to a depth of geothermal borehole to be constructed (e.g., drilled). For example, the length can be 500 feet, 2000 feet, or 4000 feet, or 10,000 feet. In some implementations, the CT string 810 is made of low-alloy carbon steel tubing.

In some implementations, the CT rig 800 includes one or more arms 812 (e.g., telescopic arms) for coupling the CT reel 808, the power unit 806, and/or the chassis 802. For example, FIG. 10A illustrates the CT rig includes a first arm 812-1 that couples the CT reel 808 to the power unit 806. FIG. 10A also illustrates the CT rig includes a second arm 812-2 that couples the CT reel 808 to the chassis 802.

In some implementations, the one or more arms 812 are adjustable (e.g., the length and/or the angle of the respective arm is adjustable). In some implementations, the one or more arms 812 are collapsible. In some implementations, the first arm 812-1 is a telescopic arm having an adjustable length. In some implementations, the second arm 812-2 is a telescopic arm having an adjustable length.

In some implementations, the first arm 812-1 and/or the second arm 812-2 is actuated via hydraulic actuation, pneumatic actuation, electromechanical actuation, or mechanical actuation (e.g., linear movement).

FIG. 10A illustrates that the CT rig 800 includes a CT injector 814 (or injector) for injecting the CT string 810 from the surface into the subsurface to construct a geothermal borehole. For example, the CT injector 814 provides the surface drive force to run the CT string underground to drill/construct a geothermal borehole (e.g., a geothermal well), and retrieves the CT out of a geothermal borehole after the drilling is completed).

In some implementations, the CT rig 800 includes one or more arms 816 for coupling the CT injector, the power unit, and/or the chassis. For example, FIG. 10A illustrates that the CT rig 800 includes a third arm 816-1 that couples the CT injector 814 to the power unit 806. FIG. 10A also illustrates the CT rig 800 includes a fourth arm 816-2 that couples the CT injector to the chassis. In some implementations, the third arm 816-1 is a telescopic arm having an adjustable length. In some implementations, the fourth arm 816-2 is a telescopic arm having an adjustable length.

In some implementations, the third arm 816-1 and/or the fourth arm 816-2 is actuated via hydraulic actuation, pneumatic actuation, electromechanical actuation, mechanical actuation (e.g., linear movement).

FIG. 10A illustrates the CT injector including a gooseneck 818 (e.g., an arch) for guiding the CT string 810 into a body of the CT injector 814. In some implementations, the gooseneck 818 is coupled to (e.g., attached to) the CT injector 814 at a fixed position (e.g., the gooseneck is not adjustable). In some implementations, the gooseneck 818 is adjustably coupled to the CT injector 814. In some implementations, the gooseneck 818 is detachable from the CT injector 814, meaning goosenecks of different sizes can be attached to the CT injector (e.g., depending on the space available for drilling).

In some implementations, the CT injector 814 and the gooseneck 818 are supported (e.g., activated) by a mast 820 (e.g., a mast structure, a rig-type structure, a crane structure, etc.). In some implementations, the mast 820 is a telescopic mast with an adjustable length (e.g., height). For example, the mast 820 includes one or more structural members. A structural member can have two or more parts that are slidably coupled to each other. Movement of one part (e.g., sliding movement, along the length of a part) sliding out from another part lengthens the mast from its rest state and changes the height between the CT injector and the ground.

In some implementations, the CT injector 814 is coupled to a blowout preventer (BOP), which is a specialized valve (or similar mechanical device) for sealing, controlling, and monitoring the geothermal well to prevent blowouts. Details of CT technology and the BOP are described in "Drilling Manual," available at https://www.drillingmanual.com/coiled-tubing-complete-guide, which is incorporated by reference herein in its entirety.

2. Adjusting the Distance Between the CT Reel and the CT Injector (or Between the CT Reel and the Gooseneck)

According to some aspects of the present disclosure, the distance between the CT reel 808 and the CT injector 814 (or a distance between the CT reel and the gooseneck) (e.g., distance D1, measured from the center of the CT reel to the top of the CT injector, as illustrated in FIG. 10A) can be modified (e.g., varied or changed) by adjusting any combination of: (i) the length of the first arm 812-1, (ii) the length of the second arm 812-2, (iii) the length of the third arm 816-1, (iv) the length of the fourth arm 816-2, and/or (v) the length/height of the mast 820.

In some implementations, the system adjusts the distance between the CT reel 808 and the CT injector 814 (e.g., the distance D1) according to the diameter of the CT string 810 (e.g., the CT size).

In some implementations, the system adjusts the distance between the CT reel 808 and the CT injector 814 (e.g., the distance D1) according to the length of the CT (e.g., the depth of the borehole to be drilled).

Generally speaking, the diameter and wall thickness of the CT string is correlated with a rigidity of the CT string (e.g., larger diameter CT strings tend to be more rigid). The drive force (from the injector) to run the CT string underground depends on the CT string size (e.g., diameter) and length, as well as the depth of the borehole. The efficiency of the force to inject the CT (e.g., CT string) into the hole depends on the distance between the CT reel and the injector.

FIG. 10A depicts that the CT string 810 is spooled on a reel 808. In some circumstances, the CT string is not fully straight when it is first released from the reel into the injector. For example, in some circumstances, the CT string has a helical/spiral shape with a pitch that is correlated with the CT string diameter and wall thickness (e.g., the smaller the diameter, the smaller the pitch).

To maximize borehole construction operational efficiency, the CT string should be straight when it is fed into the injector. Pitches in the CT string can result in decreased efficiency because the CT injector needs to provide more force to push the CT string through the subsurface.

According to some implementations of the present disclosure, the system is configured to adjust the distance D1 between the CT reel and the CT injector (or a distance between the CT reel and the gooseneck) such that the portion of the CT string as it is released from the reel to the gooseneck is as straight as possible. In some implementations, the system includes straighteners (e.g., a tubing straightening subsystem) for straightening the CT string after it is released from the reel and before it enters the injector.

3. Sensors and Sensor Data

In some implementations, the system deploys a CT enabled drill bit and collects (e.g., in real time during the constructing) sensor data from sensors (e.g., sensors 1050, FIG. 11) that are positioned on the drill bit and at the surface.

In some implementations, the sensors include a force sensor, a torque sensor, a vibration sensor, an acceleration sensor, a temperature sensor, a pressure sensor, a pH sensor, and/or a sensor that measures azimuth or orientation.

In some implementations, the sensor data includes pressure, temperature, depth correlation and azimuth, rock hardness, pumping rates, force, torque, pH, and/or vibration data.

In some implementations, the system uses the sensor data to determine (e.g., monitor) the drilling speed, the drilling force, and/or the drilling torque (e.g., the force and/or torque exerted on the drill bit).

In some implementations, the system uses the sensor data to determine the force/torque on the CT string. For example, the system can determine the force/torque on the CT string as the CT string enters the injector, or when the CT string leaves the injector, and/or when the CT string is injected into the subsurface.

In some implementations, the system can determine, based on the force and/or torque on the CT string, whether the CT string is straight or whether it has a helical shape (e.g., twisted or curly). For example, if the CT string is helical between the CT reel and the gooseneck, and the system (e.g., injector) injects the CT string at a faster rate, more vibrations and/or forces will be induced.

In some implementations, the system correlates (e.g., in real time) the injection speed with the drilling speed and determines, based on the correlation, whether the CT string is straight or helical (e.g., curly, spiral, twisted, etc.). For example, if the drilling speed is slow compared to the injection speed, there is a strong likelihood that the CT string is not straight. In some implementations, the system can dynamically adjust (e.g., automatically, in real time, during the drilling) the distance between the CT reel and the CT injector (or a distance between the CT reel and the gooseneck) to straighten the CT string based on the determination.

In some implementations, the system correlates (e.g., in real time) the drilling speed and the drilling force/torque. The system determines, based on the correlation, whether the CT string is straight or helical. For example, a high drilling force/torque coupled with a low drilling speed suggests that the CT string is not straight. In some implementations, the system dynamically adjusts (e.g., automatically, in real time during drilling/borehole construction) the distance between the CT reel and the CT injector (or a distance between the CT reel and the gooseneck) to straighten the CT string based on the determination.

Thus, as disclosed herein, the built-in sensors improve operational efficiency by ensuring that the geothermal borehole is constructed using a CT string that is largely straight. The use of the sensors also reduces the possibility of the CT string becoming buckled and/or getting stuck against the sides of a borehole. Therefore, the lifespan of the equipment can be increased as well.

Figure 11:
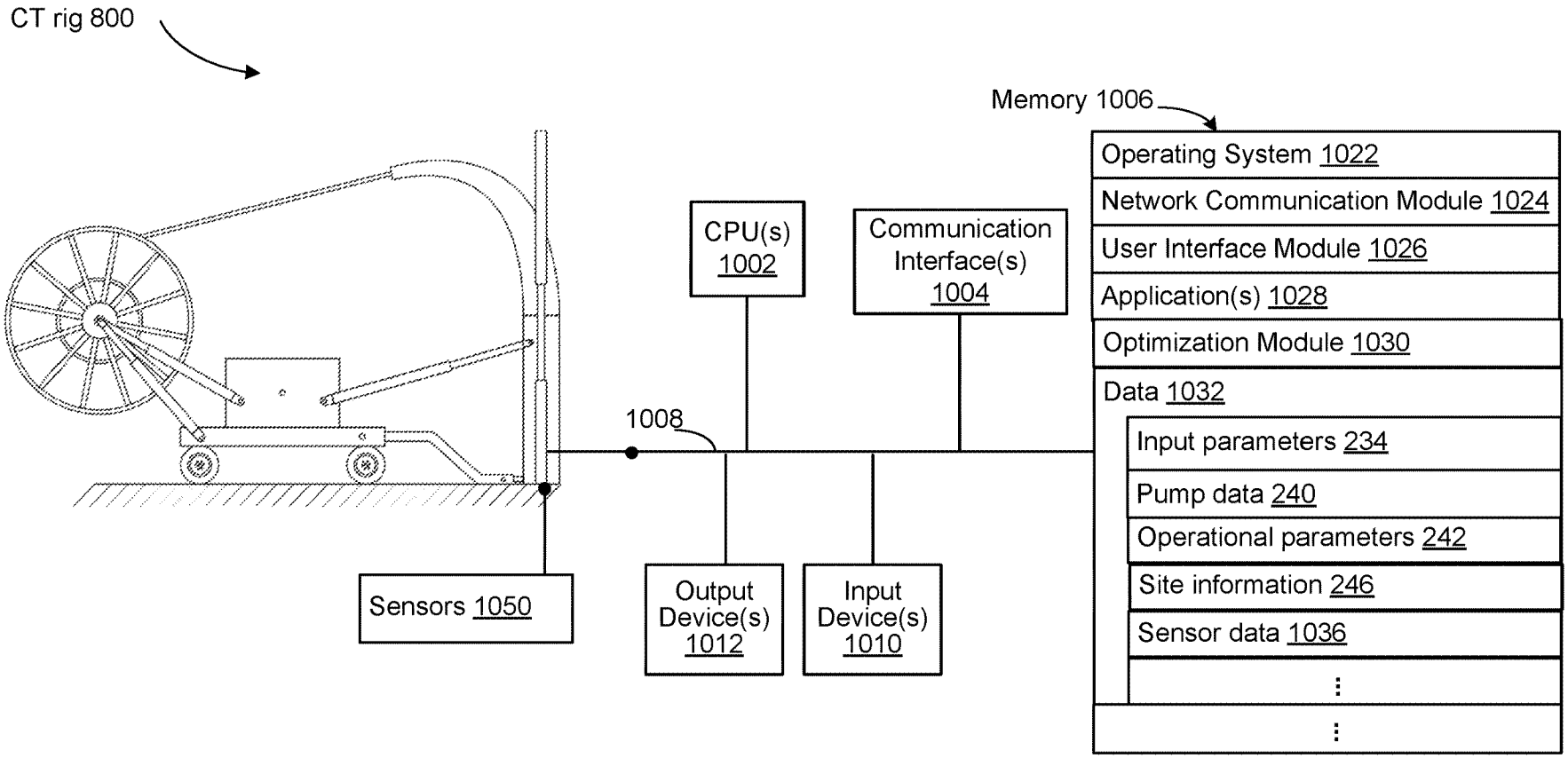
FIG. 11 illustrates a block diagram of CT rig according to some implementations.

In some implementations, the CT enabled drill bit and sensors are part of a telemetry system 900 that is described with respect to FIG. 11.

4. Transportation of CT Rig

Figure 10B:
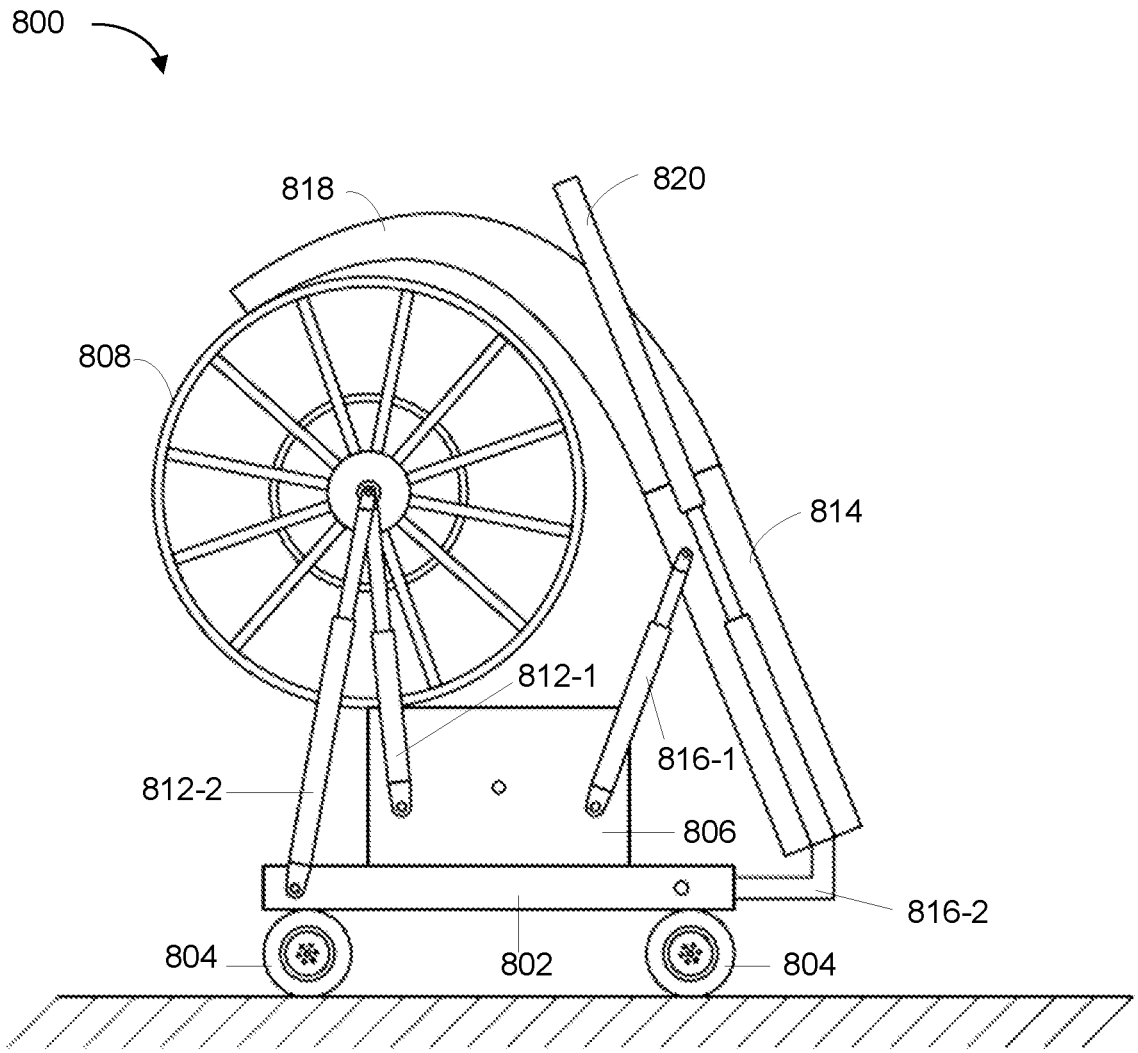

FIG. 10B illustrates the CT rig 800 according to some implementations. In some implementations, FIG. 10B represents a compact configuration of the drill rig when it is not in use (e.g., after borehole construction and/or during transportation).

In the example of FIG. 10B (and compared to FIG. 10A), the first arm 812-1 that couples the CT reel 808 to the power unit 806 has decreased in length. The second arm 812-2 that couples the CT reel 808 to the chassis 802 has increased in length. The changes in the lengths of the first arm 812-1 and the second arm 812-2 causes the CT reel 808 to be positioned above the power unit 806. In the example of FIG. 10B (and compared to FIG. 10A), the third arm 816-1 that couples the CT injector 814 to the power unit 806 has decreased in length. The fourth arm 816-2 that couples the CT injector 814 to the chassis 802 has decreased in length. The changes in the lengths of the third arm 816-1 and the fourth arm 816-2 causes the CT injector 814 to be positioned closer to the power unit 806 (e.g., the CT injector is in a "folded" position). FIG. 10B also illustrates the mast 820 has decreased in length compared to FIG. 10A.

In some implementations, instead of the telescopic design as illustrated in FIGS. 10A and 10B, the CT rig 800 is transported through urban/suburban areas by moving some of the components separately. For example, the injector and the mast can be dismantled from the rig, moved separately, and then reassembled at the next drilling site.

5. Block Diagram

FIG. 11 illustrates a block diagram of a CT rig 800 (e.g., system 800) according to some implementations.

In some implementations, the CT rig 800 includes one or more processors (e.g., processing units, or CPUs) 202, one or more network or other communication interfaces 1004, memory 1006, and one or more communication buses 1008 for interconnecting these components. In some implementations, the communication buses 1008 include circuitry (sometimes called a chipset) that interconnects and controls communications between system components.

In some implementations, the CT rig 800 is communicatively connected to one or more sensors 1050 that are positioned on a drill bit of a CT and/or a joint pipe (e.g., as described in FIGS. 4, 5, and 6). In some implementations, the CT enabled drill bit and sensors are part of a telemetry system 900 that is described with respect to FIG. 11.

In some implementations, the CT rig 800 includes one or more input devices 1010 that facilitate user input, such as a keyboard, a mouse, a voice-command input unit or microphone, a touch screen display, a touch-sensitive input pad, a gesture capturing camera, or other input buttons or controls. In some implementations, the CT rig 800 includes one or more cameras or scanners for capturing data. The CT rig 800 also includes one or more output devices 1012 that enable presentation of user interfaces and display content, including one or more speakers and/or one or more visual displays.

In some implementations, the memory 1006 includes high-speed random access memory, such as DRAM, SRAM, DDR RAM, or other random access solid state memory devices; and, optionally, includes non-volatile memory, such as one or more magnetic disk storage devices, one or more optical disk storage devices, one or more flash memory devices, or one or more other non-volatile solid state storage devices. In some implementations, the memory 1006 includes one or more storage devices remotely located from one or more processing units 1002. The memory 1006, or alternatively the non-volatile memory device(s) within the memory 1006, includes a non-transitory computer-readable storage medium. In some implementations, the memory 1006 or the computer-readable storage medium of the memory 1006 stores the following programs, modules, and data structures, or a subset or superset thereof:

- an operating system 1022, including procedures for handling various basic system services and for performing hardware dependent tasks;
- a communications module 1024, which is used for connecting the CT rig 800 to other systems, computers and devices via the one or more communication interfaces 1004 (wired or wireless), such as the communication network(s), Internet, other wide area networks, local area networks, metropolitan area networks, and so on;
- a user interface module 1026, which enables presentation of information (e.g., a graphical user interface for application(s) 1028, widgets, websites and web pages thereof, and/or audio and/or video content, text, etc.) at the system 200 via one or more output devices 212 (e.g., displays, speakers, etc.);
- one or more user applications 1028, which are executed by the system 800 (e.g., web or non-web based applications for controlling another system, electronic device, or sensors, or for reviewing data captured by such devices);
- am optimization module 1030, for determining forces/torques on the CT string 810, correlating the drilling speed and the drilling force/torque, and adjusting (the distance between the CT reel 808 and the CT injector 814 (or a distance between the CT reel and the gooseneck) to straighten the CT string based on the determination; and data 232, including, for example:
  - input parameters 234;
  - pump data 240;
  - operational parameters 242;
  - site information 246; and/or
  - sensor data 1036, which includes data from sensors 1050, sensors 904, and/or sensor data 244).

Although FIG. 11 shows a system 800, FIG. 11 is intended more as a functional description of the various features that may be present rather than as a structural schematic of the implementations described herein. In practice, and as recognized by those of ordinary skill in the art, items shown separately could be combined and some items could be separated.

Each of the above identified executable modules, applications, or sets of procedures may be stored in one or more of the memory devices, and corresponds to a set of instructions for performing a function described above. The above identified modules or programs (i.e., sets of instructions) need not be implemented as separate software programs, procedures, or modules, and thus various subsets of these modules may be combined or otherwise re-arranged in various implementations. In some implementations, the memory 1006 stores a subset of the modules and data structures identified above. Furthermore, the memory 1006 may store additional modules or data structures not described above (e.g., module(s) for machine learning and/or training models). In some implementations, a subset of the programs, modules, and/or data stored in the memory 1006 are stored on and/or executed by a server system (e.g., server system 120).

B. Subsurface Thermal Mapping for Geothermal Heating and Cooling Applications

Some aspects of the present disclosure are directed to building geothermal maps (e.g., subsurface thermal maps) for urban, suburban, and/or rural areas (e.g., for a certain location, city, county, etc.) (e.g., where buildings are located).

In some implementations, the geothermal map comprises a map of temperature and rock properties with depth, for a given location (e.g., an address, a building a city, a county, etc.). A geothermal map is useful because it can facilitate proper planning and engineering design of geothermal wells. For example, deeper geothermal boreholes can be constructed while avoiding groundwater zones and other obstructions.

In some implementations, building the geothermal map incudes obtaining (e.g., collecting) data from governments, municipalities, cities, universities, utilities, and/or other entities that have some data about the subsurface of a location.

In some implementations, building the geothermal map incudes obtaining (e.g., collecting) data from drilling jobs (e.g., sensor data acquired from geothermal borehole construction).

In some implementations, the data includes lithology data (e.g., permeability, porosity, humidity, soil and rock type, and/or heat conductivity)

In some implementations, the data includes geomechanics data (e.g., stress and strain).

In some implementations, the data includes data about groundwater zones, groundwater types, and/or obstructions (e.g., from cables, gas lines, power lines, subways, or building basements).

In some implementations, the data is logged using logging techniques (e.g., acoustic or seismic logging).

In some implementations, machine learning algorithms are developed and/or applied to identify any patterns and fill in missing and/or incomplete data.

C. Lone-Term Performance Optimization of Geothermal Heating and Cooling Systems

Some aspects of the present disclosure are directed to optimizing the long-term performance of a GHCS, by constructing a building surface map (e.g., surface thermal map of a building).

According to some implementations, data is collected from sources such as existing buildings, neighborhoods, cities, and/or counties, to identify patterns of energy loads and predict optimal performance in the future.

In some implementations, the data includes building data, such as size, shape, type, and/or age of building, wall materials, HVAC type and age, and direction of windows.

In some implementations, the data is incorporated into software that is used in conjunction with a geothermal planning and optimization system (e.g., the system 200), such that before starting a job, the system 200 knows what kind of energy load a building has, based on the data.

In some implementations, machine learning algorithms are developed and/or applied to identify any patterns and fill in missing and/or incomplete data.

D. Telemetry and Sensors for Geothermal Heating and Cooling Applications

Some aspects of the present disclosure are directed to a telemetry system for geothermal heating and cooling applications.

Figure 12:
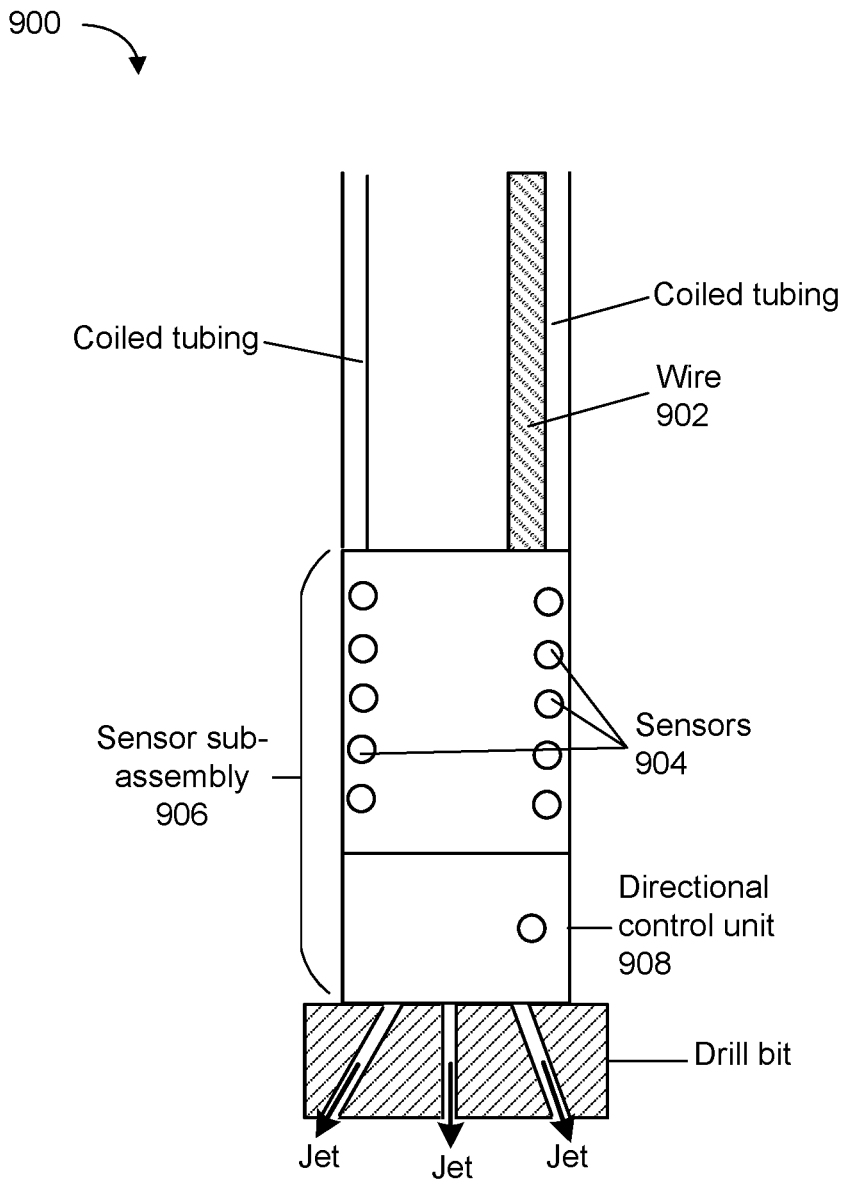
FIG. 12 illustrates a telemetry system according to some implementations.

FIG. 12 illustrates a telemetry system 900 according to some implementations.

The telemetry system 900 includes a wire 902 (e.g., telemetry wire). In some implementations, underground data collected by the sensors 904 (e.g., sensor sub-assembly 906) can be transferred to the surface automatically in real-time using the telemetry wires. In some implementations, the telemetry wire is used for transferring power from the surface to the sensors.

FIG. 12 illustrates that the telemetry system 900 includes a sensor sub-assembly 906. In some implementations, the sensor sub-assembly 906 includes a directional control unit 908 for controlling a drilling direction using data measured from an array of sensors 904. In some implementations, the directional control unit 908 is hydraulically activated. In some implementations, the directional control unit 908 is electrically activated.

The sensor sub-assembly includes a plurality of sensors. In some implementations, the plurality of sensors measures a plurality of: force, torque, pressure, temperature, vibration, pH, and/or azimuth/orientation.

In some implementations, the sensors are arranged in an array. For example, in some implementations, the sensors are arranged with a geometric pattern so as to be able to measure geological data (e.g., rock data) in three dimensions (e.g., directionally radial data).

In some implementations, the sensors are positioned on the interior surface of the drill bit or on/in the telemetry sub-assembly located between the drill bit and a CT connector. For example, the sensors that are positioned on the interior surface of the drill bit can include: a force sensor, a torque sensor, a pressure sensor, a temperature sensor, a vibration sensor, a pH sensor, a gamma ray sensor, and/or an azimuth/orientation sensor.

In some implementations, the sensors are positioned on the exterior surface of the drill bit or in/on the telemetry sub-assembly located between the drill bit and a CT connector. For example, the sensors that are positioned on the exterior surface of the drill bit can include: a force sensor, a torque sensor, a pressure sensor, a temperature sensor, a vibration sensor, a pH, a gamma ray sensor, and/or an azimuth/orientation sensor.

In some implementations, the sensor sub-assembly (e.g., the telemetry system) uses force and/or vibration data obtained (e.g., measured) by the force and/or vibration sensors, to calibrate the data measured by the other sensors (e.g., pressure data, temperature data, etc.) based on the measured vibrations. Without this calibration, the data can be noisy.

In some implementations, vibration data obtained by the sensors (e.g., force sensor and/or vibration sensor) can be used for labeling the rock type corresponding to the subsurface that is drilled. For example, the labeling can be performed in a laboratory for different rock types and the rock data is packaged in software accompanying the sensor sub-assembly, such that during drilling the rock type can be identified if the real-time vibration data matches the lab data.

In some implementations, the sensor sub-assembly is a universal sub-assembly (e.g., a standalone module that can be installed independently on any one of a variety of drill bits corresponding to a respective drill bit technology. The variety of drill bits can include: a hydraulically activated drill bit, an electrically activated drill bit, a laser drill bit, a plasma drill bit, and/or a jetting drill bit. The jetting drill bit can employ high-pressure jetting using water and/or an acid fluid as the jet fluid.

In some implementations, the sensor sub-assembly is configured for installation on a system that employs coiled tubing drilling (e.g., system or CT rig 800).

In some implementations, the sensor sub-assembly is configured to be installed on a system that employs joint pipe.

E. Geothermal Borehole Design and Construction

Some aspects of the present disclosure are directed to the design of geothermal boreholes. Alongside the construction of deeper (e.g., between 1,000 feet and 4,000) geothermal wells is the opportunity to design boreholes that are different from current residential geothermal boreholes that are 300 to 600 feet, or oil and gas wells that are on the order of tens of thousands of feet.

1. Casing

According to some implementations, a casing (e.g., geothermal casing) can be installed on a geothermal borehole after the borehole has been drilled. For example, the casing can be a pipe that is installed in a borehole to ensure that the borehole does not collapse.

In some implementations, the casing is made of a material such as carbon steel, chromium-13, carbon fiber, or any combination of these materials.

In some implementations, the casing is continuous (there is one casing that extends along a length (e.g., a partial length or an entire length) of the borehole).

In some implementations, the casing comprises multiple, discontinuous segments (e.g., sections or portions) that are installed along sections of the borehole (e.g., the total length of the casing is less than the total length of the borehole).

In some implementations, the segments are of the same length. In some implementations, the segments have different lengths.

In some implementations, a borehole can include multiple (e.g., two or more) segments of casing that are of the same width (e.g., diameter). In some implementations, a borehole can include multiple segments (e.g., two or more) of casings, where at least two of the segments have different widths (e.g., diameters).

In some implementations, the casing material(s) are selected based on cost and based on their ability to withstand stresses (e.g., forces, pressure, etc.) exerted by the rocks (e.g., the subsurface terrain) on the geothermal borehole. In some implementations, the number of segments of casing, their lengths and/or widths are selected based on their ability to withstand stresses (e.g., forces, pressure, etc.) exerted by the rocks on the geothermal borehole. In some implementations, the stressed exerted by the rocks (e.g., the subsurface terrain) on the geothermal borehole are measured during construction of the geothermal borehole. For example, as described above, sensor data can be collected, automatically and in real-time, from sensors that are positioned on/in the drill bit. The sensor data (e.g., force, pressure, and/or stress data) can guide/inform a driller on the casing material and configuration.

In some circumstances, the decision to install a casing can also depend on the depth of the geothermal borehole. For example, a casing may not be necessary for a shallower (e.g., 300 feet, 500 feet, or 1,000 feet) borehole because the forces (e.g., pressure or stresses) exerted by the rocks on the shallower borehole tend to be less than those exerted on a deeper borehole. The sensor data (e.g., force, pressure, and/or stress data) can guide/inform a driller on this decision.

2. Grout/Cement

According to some implementations, grout/cement can be cured (e.g., applied on) an entire borehole length, or placed on a subset of locations of the borehole (e.g., one or more sections of the borehole), such as near the borehole surface or at the bottom of the borehole.

3. Friction Reducers

Oil and gas wells are about 20,000 feet long (e.g., deep) and use casings that are 3 to 6.5 inches in diameter. The pressure drop of a fluid flowing through such as well is significant. Friction reducers are routinely used in the oil and gas industry to reduce the friction of the fluid as the fluid moves through the pipe. It is estimated that with friction reducers, the pressure drop along a 20,000 feet well can reduce by 30-40%. This means that less energy (e.g., power) is needed to move the fluid through the long pipes. One key drawback of friction reducers that are currently used in the oil and gas industry is that they can be harmful to the environment, humans, and animals.

Currently, friction reducers are not used in shallow geothermal systems in urban, suburban and rural areas because the pressure drop along a ~300 feet deep geothermal well is insignificant. However, as the industry moves toward constructing deeper (e.g., 1,000 feet to 4,000 feet) geothermal wells for urban/suburban/commercial uses, the pressure drop along these wells can become significant.

According to some aspects of the present disclosure, friction reducers can be added to the geothermal fluid, to decrease the pressure drop along the geothermal loop and decrease the pumping pressure at the surface. This can in turn lead to a decrease in operating expenditures.

According to some aspects of the present disclosure, friction reducers are developed for use in a geothermal system. Unlike the friction reducers found in the oil and gas industry, the friction reducers here are environmentally friendly, and suitable for use in urban/suburban/rural areas. They are also not harmful to humans and animals. In some implementations, the friction reducer is an oil-based fluid.

4. Geothermal Loop

Figure 13:
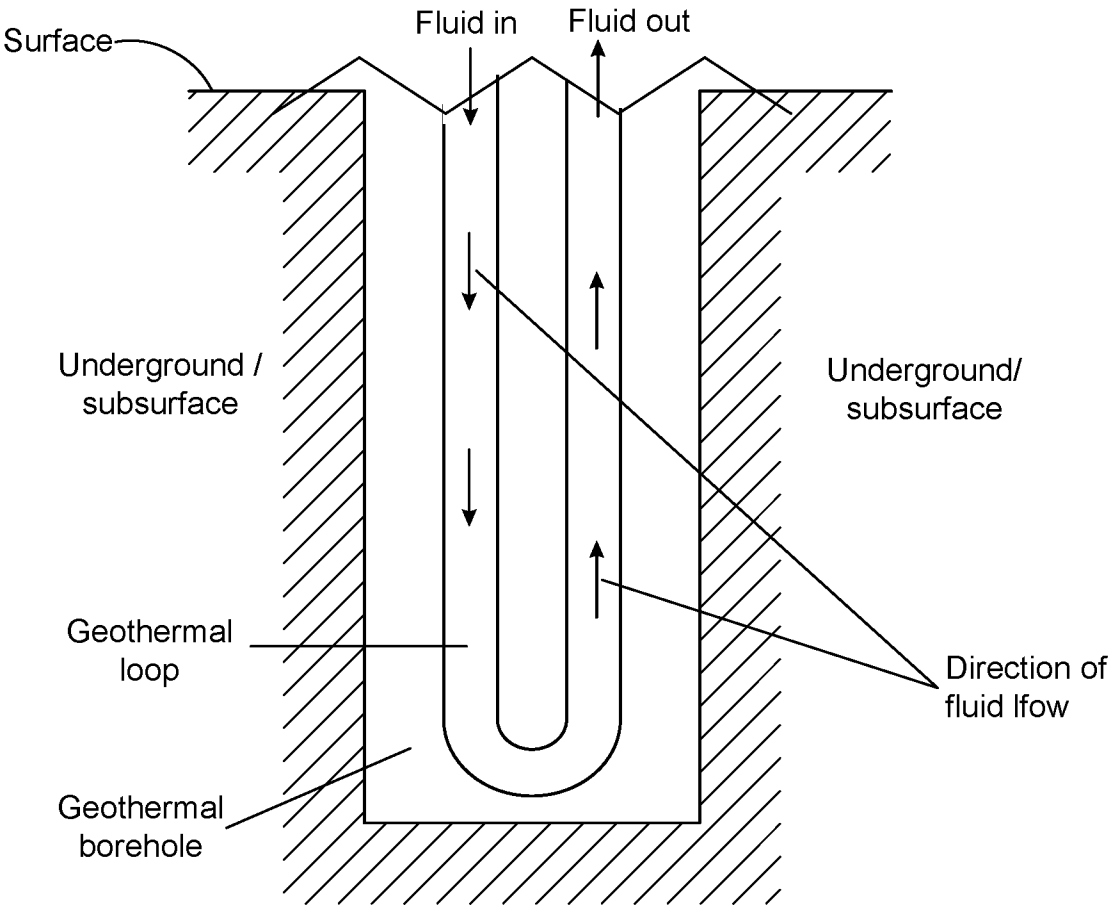
FIG. 13 illustrates a geothermal loop according to some implementations.

FIG. 13 illustrates a geothermal loop according to some implementations. In this example, the geothermal loop comprises a "U-loop" (e.g., a U-shaped loop) that is typically found in existing geothermal systems.

According to some aspects of the present disclosure, a geothermal loop can comprise concentric pipes or a continuous loop.

Figure 14B:
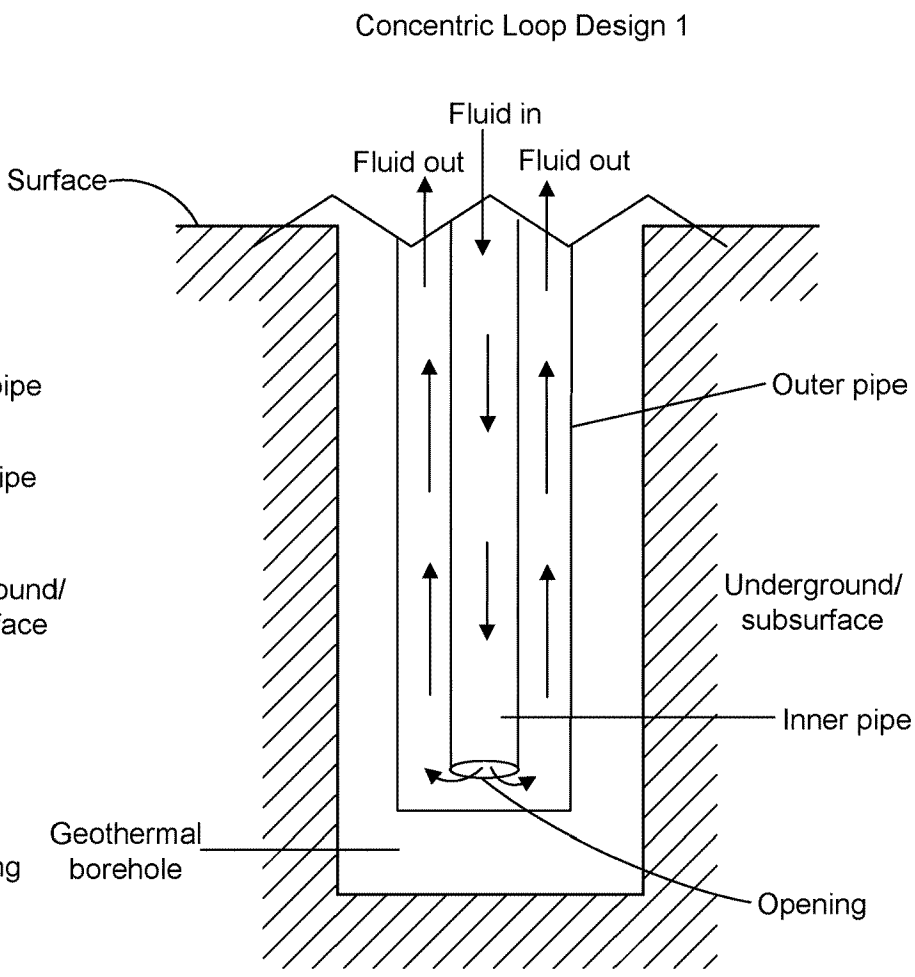
FIGS. 14A and 14B illustrate a geothermal loop according to some implementations.
Figure 14A:
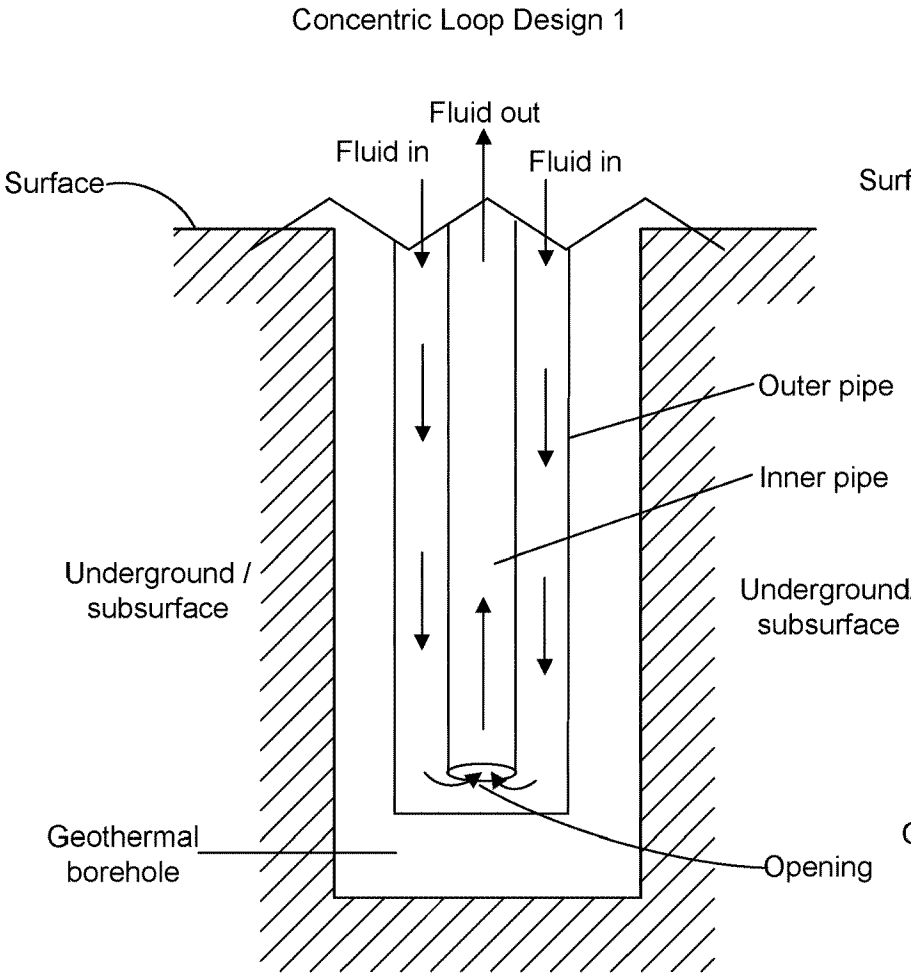

FIGS. 14A and 14B illustrate a geothermal loop according to some implementations. In this example, the geothermal loop comprises a concentric geothermal loop that includes an outer pipe that is concentrically arranged with an inner pipe (e.g., a long axis of the outer pipe is parallel to a long axis of the inner pipe, the outer pipe and the inner pipe have the same long axis, etc.). The inner pipe includes a space/opening at the bottom of the inner pipe, such that (i) geothermal fluid that is pumped down the inner pipe can flow up the outer pipe via the space/opening, or (ii) geothermal fluid that is pumped down the outer pipe can flow up the inner pipe via the space/opening.

For cooling, the geothermal fluid can be pumped down the outer pipe and can flow up the inner pipe, as illustrated in FIG. 14A. For heating, the geothermal fluid can be pumped down the inner pipe and can flow up the outer pipe, as illustrated in FIG. 14B.

In some implementations, the geothermal loop (e.g., concentric geothermal loop or continuous geothermal loop) can be installed at the same time with casing, or after the casing is installed.

In some implementations, the geothermal loop (e.g., concentric geothermal loop or continuous geothermal loop) can be sized to use a "thermosyphon" effect to reduce pumping pressure.

Figure 15B:
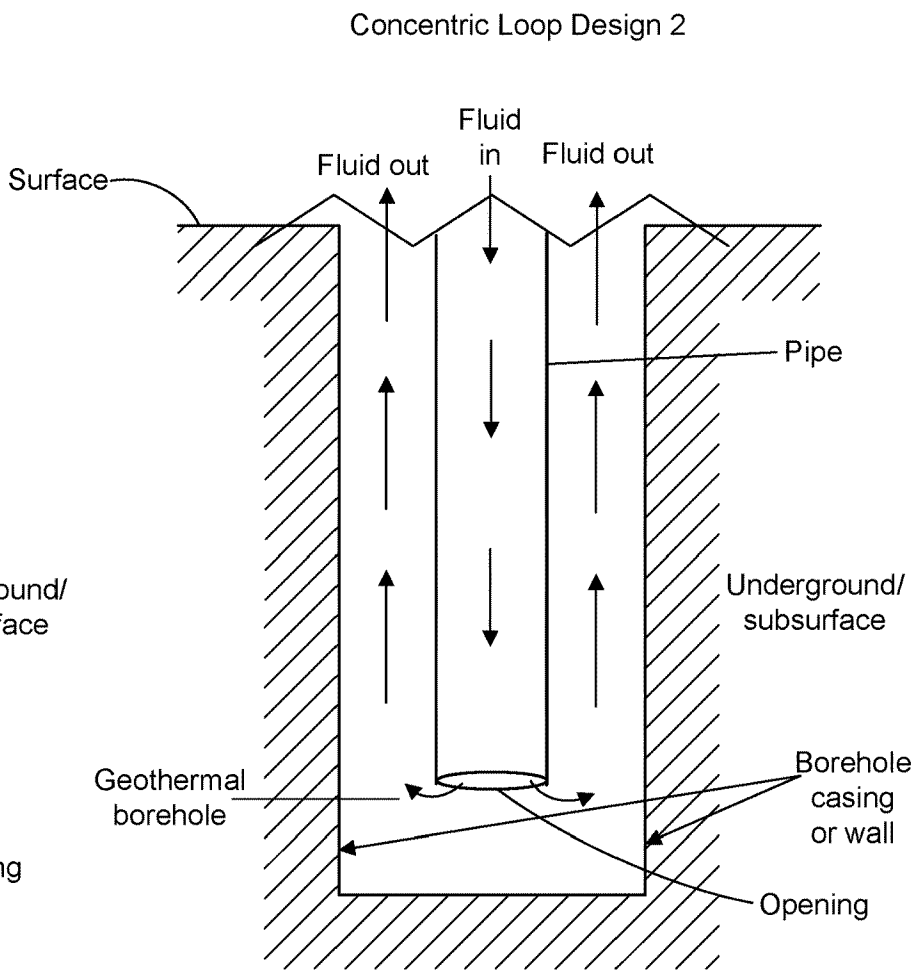
FIGS. 15A and 15B illustrate a geothermal loop according to some implementations.
Figure 15A:
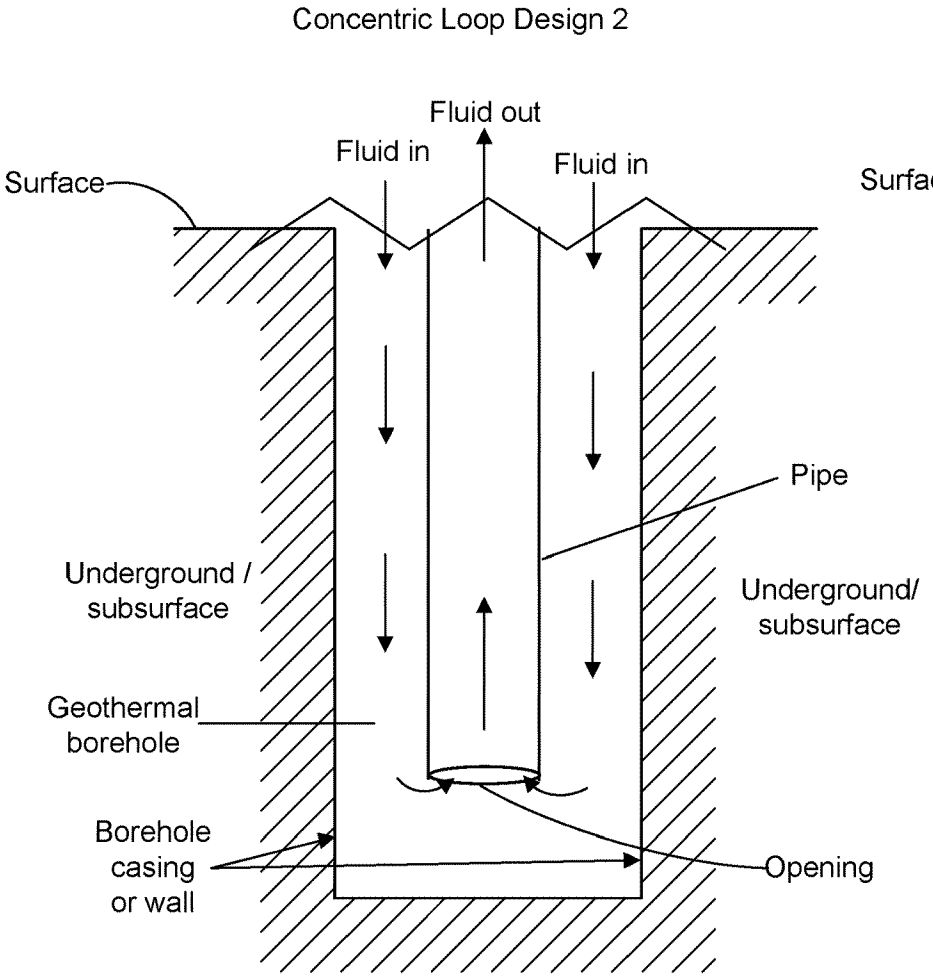

FIGS. 15A and 15B illustrate a geothermal loop according to some implementations. In this example, the geothermal loop comprises a concentric geothermal loop, where the "outer pipe" can be either a borehole casing or a wall of the geothermal borehole, and the inner pipe is a pipe as discussed with respect to FIGS. 14A and 14B. For cooling, the geothermal fluid can be pumped down the outer pipe and can flow up the inner pipe, as illustrated in FIG. 15A. For heating, the geothermal fluid can be pumped down the inner pipe and can flow up the outer pipe, as illustrated in FIG. 15B.

According to some implementations of the present disclosure, the concentric geothermal loops have several advantages over the existing geothermal loops (e.g., the U-loop in FIG. 13). First, the concentric pipes are cheaper to install than the U-shaped pipes. Second, the concentric pipes are easier to install than the U-shaped pipes. Currently, the geothermal loops (e.g., pipes) for residential geothermal systems are installed manually, with workers laying the pipes horizontally or pushing the pipes down (e.g., 20 to 200 feet). Because geothermal wells for urban/suburban/commercial uses tend to be deeper than those for residential uses (e.g., 1,000-2,000 feet for urban/suburban/commercial uses, compared to 20-600 feet for residential uses), the volume of pipes makes it heavy for manual handling. The concentric pipes can be manufactured (e.g., as a unit) and injected into a geothermal borehole, using technology as a CT drill rig and CT injector (e.g., as described in FIGS. 10A and 10B above), thus making the installation process easier and less labor-intensive.

F. Flowchart

Figure 16:
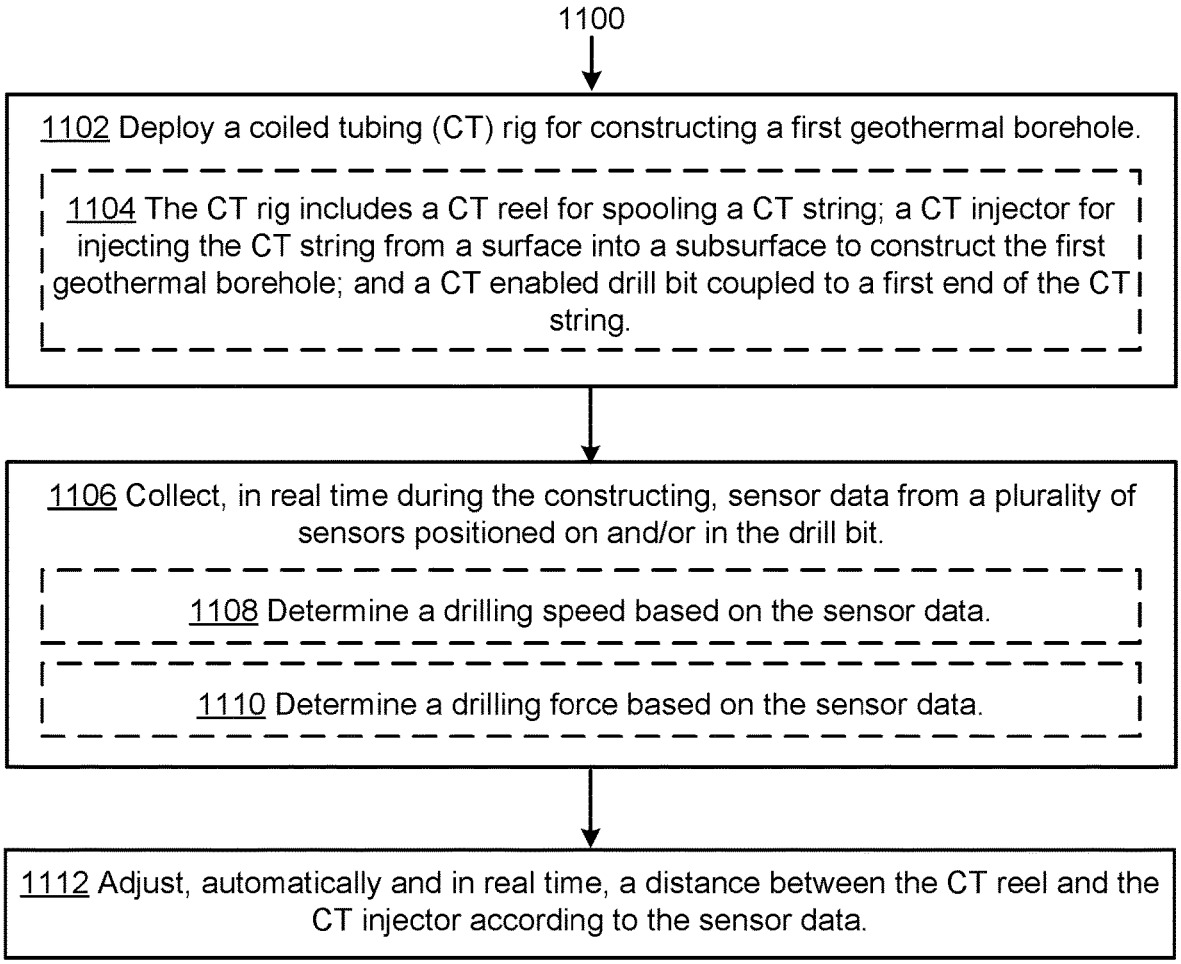
FIG. 16 provides a flowchart of a method according to some implementations

FIG. 16 provides a flowchart of a method 1100 according to some implementations.

In some implementations, the method is performed by a CT rig 800 that includes one or more processors 1002 and memory 1006. The memory 1006 stores one or more programs configured for execution by the one or more processors 1002. In some implementations, the operations shown in FIGS. 10A, 10B, 11, and 12 correspond to instructions stored in the memory 1006 or other non-transitory computer-readable storage medium. The computer-readable storage medium may include a magnetic or optical disk storage device, solid state storage devices such as Flash memory, or other non-volatile memory device or devices. The instructions stored on the computer-readable storage medium may include one or more of: source code, assembly language code, object code, or other instruction format that is interpreted by one or more processors. Some operations in the method 700 may be combined and/or the order of some operations may be changed.

The method 1100 includes deploying (1102) a coiled tubing (CT) rig (e.g., CT rig 800) for constructing a first geothermal borehole. The CT rig includes (1104) a CT reel for spooling a CT string; a CT injector for injecting the CT string from a surface into a subsurface to construct the first geothermal borehole; and a CT enabled drill bit coupled to a first end of the CT string.

The method 1100 includes collecting (1106), in real time during the constructing, sensor data from a plurality of sensors positioned on and/or in the drill bit.

In some implementations, the method 1100 includes determining (1108) a drilling speed based on the sensor data.

In some implementations, the method 1100 includes determining (1110) a drilling force based on the sensor data.

The method 1100 includes adjusting (1112), automatically and in real time, a distance between the CT reel and the CT injector according to the sensor data.

The terminology used in the description of the invention herein is for the purpose of describing particular implementations only and is not intended to be limiting of the invention. As used in the description of the invention and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

As used herein, the phrase "based on" does not mean "based only on," unless expressly specified otherwise. In other words, the phrase "based on" describes both "based only on" and "based at least on."

As used herein, the term "exemplary" means "serving as an example, instance, or illustration," and does not necessarily indicate any preference or superiority of the example over any other configurations or implementations.

As used herein, the term "and/or" encompasses any combination of listed elements. For example, "A, B, and/or C" includes the following sets of elements: A only, B only, C only, A and B without C, A and C without B, B and C without A, and a combination of all three elements, A, B, and C.

The foregoing description, for purpose of explanation, has been described with reference to specific implementations. However, the illustrative discussions above are not intended to be exhaustive or to limit the invention to the precise forms disclosed. Many modifications and variations are possible in view of the above teachings. The implementations were chosen and described in order to best explain the principles of the invention and its practical applications, to thereby enable others skilled in the art to best utilize the invention and various implementations with various modifications as are suited to the particular use contemplated.

What is claimed is:

1. A system for constructing geothermal boreholes, comprising:

a power unit;

a coiled tubing (CT) reel for spooling a CT string;

a drill bit coupled to a first end of the CT string;

a CT injector configured to inject the CT string from a surface into a subsurface via the first end of the CT string to construct a geothermal borehole, the CT injector including a gooseneck positioned between the CT reel and the CT injector, the gooseneck configured to guide the CT string into a body of the CT injector as the CT string is unspooled from the CT reel;

a first arm for coupling the CT reel and the power unit; and a second arm for coupling the CT injector and the power unit, wherein:

during operation of the system, the system is configured to:

obtain a drilling speed and a drilling force of the drill bit;

determine, based on a correlation between the drilling speed and the drilling force, whether the CT string is straight or helical; and in accordance with a determination that the CT string is helical, modify a distance between the CT reel and the gooseneck by adjusting at least one of (i) a length of the first arm or (ii) a length of the second arm, so as to straighten the CT string as the CT string enters the body of the CT injector via the gooseneck.

2. The system of claim 1, wherein the first arm comprises a telescopic arm.

3. The system of claim 1, wherein the second arm comprises a telescopic arm.

4. The system of claim 1, wherein the CT injector and the gooseneck are supported by a mast.

5. The system of claim 4, wherein the mast comprises a telescopic mast.

6. The system of claim 1, wherein the system is configured to modify the distance between the CT reel and the gooseneck according to a diameter of the CT string.

7. The system of claim 1, wherein the system is configured to modify the distance between the CT reel and the gooseneck according to a length of the CT string and/or a planned depth of a geothermal borehole to be constructed.

8. The system of claim 1, wherein the system is configured to modify the distance between the CT reel and the gooseneck for transporting the system.

9. The system of claim 1, wherein the system is configured to adjust the distance between the CT reel and the gooseneck according to a depth of a geothermal borehole to be constructed.

10. The system of claim 1, wherein:

the power unit is mounted on a chassis of the system; and the system further includes:

a third arm for coupling the CT reel and the chassis; and a fourth arm for coupling the CT injector and the chassis.

11. The system of claim 10, wherein the system is configured to modify the distance between the CT reel and the gooseneck by adjusting at least one of (i) a length of the third arm or (ii) a length of the fourth arm.

12. The system of claim 10, wherein the third arm and the fourth arm are telescopic arms.

13. The system of claim 1, further comprising:

a plurality of sensors mounted (i) on and/or in the drill bit or (ii) on a telemetry subassembly between the drill bit and a CT connector.

14. The system of claim 13, wherein:

the plurality of sensors includes a force sensor and/or a torque sensor; and the system is configured to modify, according to sensor data from the force sensor and/or the torque sensor, one or more of: a drilling direction, the drilling speed, and an injection speed of the CT injector.

15. The system of claim 1, further comprising:

a plurality of sensors positioned at the surface.

16. The system of claim 1, wherein the system is configured to perform the correlation between the drilling speed and the drilling force in real time, during the operation of the system.

17. The system of claim 1, wherein the system is configured to, during the operation of the system:

determine an injection speed of the CT injector; and determine whether the CT string is straight or helical based on a correlation between the injection speed and the drilling speed.

18. The system of claim 17, wherein the system is configured to perform the correlation between the injection speed and the drilling speed in real time, during the operation of the system.

* * * * *